US008444472B2

(12) United States Patent
Vancura

(10) Patent No.: US 8,444,472 B2
(45) Date of Patent: May 21, 2013

(54) CASINO GAMES AND METHODS OF PLAY FOR A CASINO GAMING MACHINE

(76) Inventor: Olaf Vancura, Las Vegas, NV (US)

( * ) Notice: Subject to any disclaimer, the term of this patent is extended or adjusted under 35 U.S.C. 154(b) by 418 days.

(21) Appl. No.: 12/511,828

(22) Filed: Jul. 29, 2009

(65) Prior Publication Data

US 2010/0029381 A1 Feb. 4, 2010

Related U.S. Application Data

(60) Provisional application No. 61/084,362, filed on Jul. 29, 2008, provisional application No. 61/170,435, filed on Apr. 17, 2009.

(51) Int. Cl.
*A63F 9/24* (2006.01)

(52) U.S. Cl.
USPC ..... 463/20

(58) Field of Classification Search
USPC ..... 463/30; 462/20
See application file for complete search history.

(56) References Cited

U.S. PATENT DOCUMENTS

| | | | | |
|---|---|---|---|---|
| 6,089,976 | A * | 7/2000 | Schneider et al. | 463/16 |
| 6,851,674 | B2 | 2/2005 | Pierce et al. | |
| 6,884,173 | B2 | 4/2005 | Gauselmann | |
| 6,896,261 | B2 | 5/2005 | Pierce et al. | |
| 7,364,159 | B2 * | 4/2008 | Berman et al. | 273/138.1 |
| 7,722,451 | B2 * | 5/2010 | Hughs-Baird et al. | 463/9 |
| 2004/0048646 | A1 * | 3/2004 | Visocnik | 463/16 |

* cited by examiner

*Primary Examiner* — Corbett B Coburn
(74) *Attorney, Agent, or Firm* — Weide & Miller, Ltd.

(57) ABSTRACT

Casino games and methods having a set of objects displayed in a screen of a casino gaming machine. Each object has a randomly assigned attribute from a corresponding set of attributes. The casino gaming machine receives the player's input for each of a predetermined number of objects in the set. When selected, a symbol corresponding to the hidden attribute is displayed. After each input, the remaining attributes of the remaining objects not selected are randomly reassigned to each unselected object before the player selects the next object.

15 Claims, 20 Drawing Sheets

3 TRIGGERS IN BASE GAME:

| |
|---|
| "GO" SYMBOL |
| ONE OF 35X, 40X, 50X, 55X LINE WAGER |
| ONE OF 60X, 65X, 70X, 75X, 100X LINE WAGER |

4 TRIGGERS IN BASE GAME:

| |
|---|
| "GO" SYMBOL |
| "GO" SYMBOL PLUS 50X |
| ONE OF 70X, 75X, 80X, 85X, 90X LINE WAGER |
| ONE OF 100X, 125X, 150X, 175X, 200X LINE WAGER |

5 TRIGGERS IN BASE GAME:

| |
|---|
| "GO" SYMBOL |
| "GO" SYMBOL PLUS 75X |
| "GO" SYMBOL PLUS 150X |
| ONE OF 100X, 125X, 150X, 175X, 200X LINE WAGER |
| ONE OF 250X, 300X, 400X, 500X LINE WAGER |

FIGURE 4

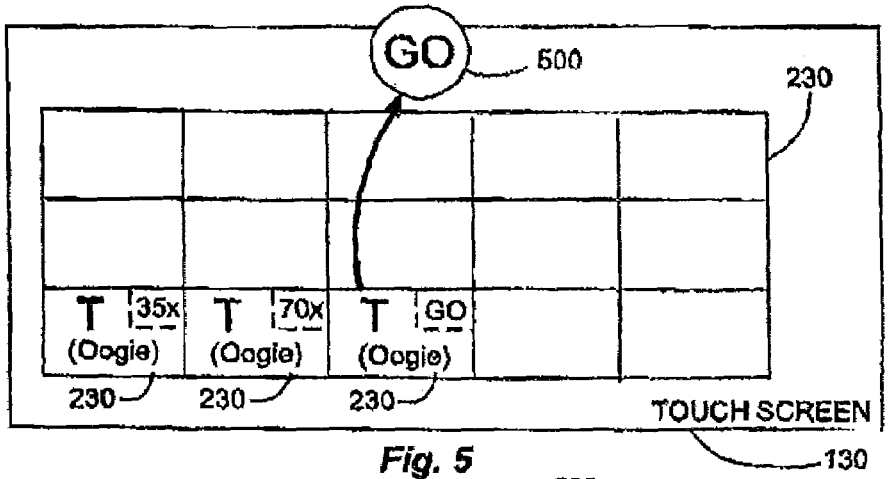
Fig. 5
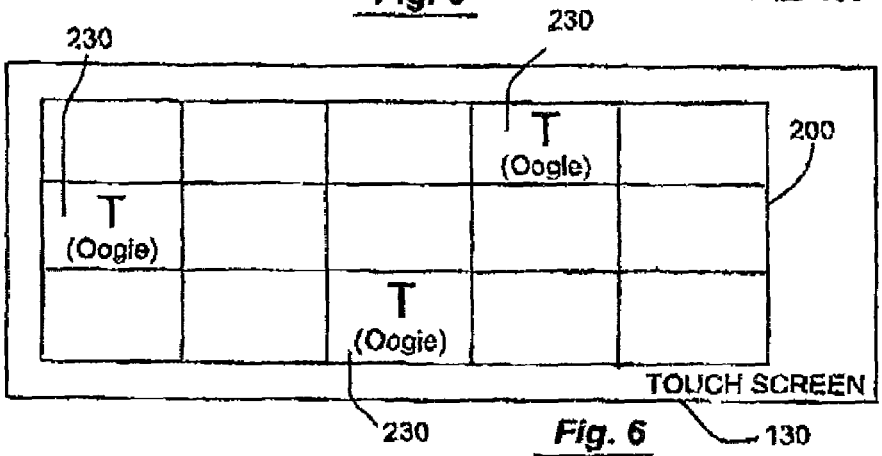
Fig. 6
Fig. 7
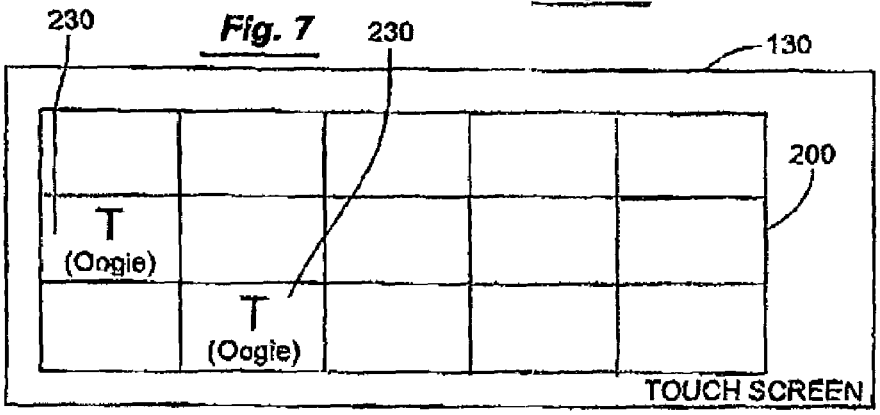

| 3 TRIGGERS | 4 TRIGGERS | 5 TRIGGERS |
|---|---|---|
| 10X | 25X | 100X |
| 15X | 30X | 125X |
| 20X | 40X | 150X |
| 25X | 45X | 175X |
| 30X | 50X | 200X |
| 35X | 60X | 225X |
| 40X | 75X | 250X |
| 45X | 80X | 275X |
| 50X | 100X | 300X |
| 55X | 120X | 325X |
| 60X | 140X | 350X |
| 75X | 160X | 400X |
| PACHINKO 1 | PACHINKO 1 | PACHINKO 1 |
| PACHINKO 2 | PACHINKO 2 | PACHINKO 2 |
| PACHINKO 3 | PACHINKO 3 | PACHINKO 3 |

FIGURE 10

| NUMBER OF PACHINKO GAMES | PROBABILITY |
|---|---|
| 0 | 0.2637 |
| 1 | 0.4945 |
| 2 | 0.2198 |
| 3 | 0.0220 |

FIGURE 12

| 3 TRIGGERS | 4 TRIGGERS | 5 TRIGGERS |
|---|---|---|
| 15X | 30X | 125X |
| 20X | 35X | 125X |
| 25X | 40X | 150X |
| 25X | 45X | 175X |
| 30X | 50X | 200X |
| 35X | 50X | 200X |
| 35X | 55X | 225X |
| 40X | 60X | 250X |
| 40X | 75X | 275X |
| 45X | 80X | 275X |
| 50X | 90X | 300X |
| 60X | 100X | 300X |
| PACHINKO 1 | PACHINKO 1 | PACHINKO 1 |
| PACHINKO 2 | PACHINKO 2 | PACHINKO 2 |
| PACHINKO 3 | PACHINKO 3 | PACHINKO 3 |

FIGURE 13

| 2 Triggers | | 3 Triggers | | 4 Triggers | |
|---|---|---|---|---|---|
| Prob | Lane Value | Prob | Lane Value | Prob | Lane Value |
| 0.0600 | 750 | 0.1200 | 1000 | 0.0700 | 2000 |
| 0.0700 | 800 | 0.1200 | 1200 | 0.0700 | 2500 |
| 0.0700 | 850 | 0.1300 | 1250 | 0.1200 | 2750 |
| 0.0800 | 900 | 0.1000 | 1500 | 0.1700 | 3000 |
| 0.1100 | 1000 | 0.1100 | 1750 | 0.1400 | 3250 |
| 0.1200 | 1200 | 0.1400 | 2000 | 0.1300 | 3500 |
| 0.1300 | 1250 | 0.1700 | 2500 | 0.1500 | 4000 |
| 0.1200 | 1500 | 0.0600 | 3000 | 0.0500 | 4500 |
| 0.1100 | 1750 | 0.0300 | 4000 | 0.0400 | 5000 |
| 0.0800 | 2000 | 0.0200 | 5000 | 0.0200 | 6000 |
| 0.0300 | 2500 | | | 0.0200 | 7500 |
| 0.0200 | 3000 | | | 0.0200 | 10000 |

FIGURE 15

| 2 Triggers | | 3 Triggers | | 4 Triggers | |
|---|---|---|---|---|---|
| Prob | Lane Value | Prob | Lane Value | Prob | Lane Value |
| 0.0300 | 60 | 0.0500 | 100 | 0.0200 | 150 |
| 0.0400 | 75 | 0.0500 | 110 | 0.0200 | 175 |
| 0.0400 | 80 | 0.0400 | 115 | 0.0200 | 200 |
| 0.0400 | 85 | 0.0500 | 120 | 0.0200 | 225 |
| 0.0300 | 90 | 0.0600 | 125 | 0.0300 | 250 |
| 0.0400 | 100 | 0.0500 | 135 | 0.0300 | 275 |
| 0.0300 | 120 | 0.0600 | 150 | 0.0500 | 300 |
| 0.0400 | 125 | 0.0500 | 160 | 0.0500 | 325 |
| 0.0400 | 135 | 0.0400 | 170 | 0.0500 | 350 |
| 0.0500 | 150 | 0.0400 | 175 | 0.0600 | 375 |
| 0.0400 | 160 | 0.0400 | 180 | 0.0500 | 400 |
| 0.0400 | 170 | 0.0400 | 200 | 0.0500 | 450 |
| 0.0600 | 175 | 0.0400 | 225 | 0.0700 | 500 |
| 0.0600 | 180 | 0.0500 | 250 | 0.0500 | 525 |
| 0.0700 | 200 | 0.0400 | 275 | 0.0400 | 550 |
| 0.0600 | 225 | 0.0500 | 300 | 0.0500 | 600 |
| 0.0500 | 250 | 0.0400 | 325 | 0.0400 | 650 |
| 0.0500 | 275 | 0.0400 | 350 | 0.0300 | 700 |
| 0.0500 | 300 | 0.0300 | 375 | 0.0400 | 750 |
| 0.0400 | 325 | 0.0400 | 400 | 0.0300 | 800 |
| 0.0300 | 350 | 0.0300 | 500 | 0.0200 | 850 |
| 0.0300 | 375 | 0.0200 | 600 | 0.0200 | 900 |
| 0.0200 | 400 | 0.0100 | 700 | 0.0400 | 1000 |
| 0.0100 | 500 | 0.0100 | 750 | 0.0200 | 1200 |
| 0.0100 | 600 | 0.0100 | 800 | 0.0300 | 1250 |
| | | 0.0100 | 1000 | 0.0300 | 1500 |
| | | 0.0100 | 1250 | 0.0100 | 1750 |
| | | | | 0.0200 | 2000 |
| | | | | 0.0100 | 2500 |

FIGURE 16

CLOUD VALUES

| 3 TRIGGERS | 4 TRIGGERS | 5 TRIGGERS |
|---|---|---|
| 15X | 40X | 100X |
| 20X | 50X | 125X |
| 25X | 60X | 150X |
| 30X | 75X | 200X |
| 35X | 80X | 250X |
| 40X | 100X | 300X |
| ALL | ALL | ALL |

FIGURE 19

PEEK PROBABILITIES

| # OF PEEKS | 3 TRIGGERS | 4 TRIGGERS | 5 TRIGGERS |
|---|---|---|---|
| 1 | 0.50 | 0.30 | 0 |
| 2 | 0.35 | 0.45 | 0.50 |
| 3 | 0.15 | 0.15 | 0.30 |
| 4 | 0 | 0.10 | 0.20 |

FIGURE 20

CASINO GAMES AND METHODS OF PLAY FOR A CASINO GAMING MACHINE

RELATED APPLICATIONS

This application claims priority to the provisional application entitled "Method of Playing a Gaming Device" filed on Jul. 29, 2008 (Application No. 61/084,362) and to "Method of Playing a Gaming Device filed on Apr. 17, 2009 (Application No. 61/170,435).

BACKGROUND OF THE INVENTION

1. Field of the Invention

The invention relates to casino games and methods of play in casino gaming machines and, in particular, to casino gaming machines that have bonus play features.

2. Discussion of the Background

Casino game machines such as a slot machine are a staple of the casino industry. Slot machines having an underlying casino base game with an accompanying bonus game are also well known. In particular, a bonus game manifested as a "game within a game" is popular. Likewise, placing the bonus game in a top box physically above the base game, especially to attract attention and to make players feel special, are well known.

Typically, bonus games are triggered, or activated, based on the random play of the underlying base game. Once triggered, a bonus condition is issued. Dedicated base game symbols known as "triggers" are often used, although the bonus game may be triggered by other random events.

A continuing need exists in the casino gaming industry to provide new and exciting games to the playing public. A need exists in the casino gaming industry to create methods of playing bonus games, as often players are motivated to play slot machines to get into the bonus games themselves. A need exists to enhance mechanical bonus features which utilize mechanical apparatus, especially features which utilize free motion. A need further exists in the casino gaming industry to have more than one type of bonus game available for a particular casino base game.

The operating hardware and software necessary to implement a slot machine is well known and is based on one or more communicatively interconnected controllers, processors, or microprocessors [hereinafter collectively referred to as a computer] found within a casino base game. Typically, the computer is responsive to wagers placed, payouts made, and various touchscreen or button inputs from the player. These hardware/software configurations in such slot machines are commonly referred to as casino gaming platforms, and casino gaming platforms vary among the various casino game machine manufacturers. Game play logic, choreography, graphics and video sequences and mathematics are coded onto casino gaming machine platforms via software and/or firmware conventionally. In general, gaming platforms have application outside the casino industry such as in consumer games, military use, etc. An example of one casino gaming machine among many is found in U.S. Pat. No. 6,884,173. A need exists to implement, on such conventional gaming machine platforms, new casino games and new methods for players to enjoy.

SUMMARY OF THE INVENTION

A method for playing a casino game played in a casino gaming machine wherein a set of objects is displayed in a touch screen of the casino gaming machine. Each object having a randomly assigned attribute from a corresponding set of attributes, the casino gaming machine receives the player's input for each of a predetermined number of objects in said set. When touched, a symbol or numeric value corresponding to said randomly associated attribute for each touched object is displayed. After each touch input, the remaining attributes of the remaining objects that have not been touched are reassigned to the untouched objects before the player touches the next object.

A method for playing a casino game in a casino gaming machine having a set of objects is displayed in a touch screen of the casino gaming machine. Each displayed object having a randomly assigned attribute from a corresponding set of attributes. The set of attributes contains at least numeric values and at least one bonus game play symbol. The casino gaming machine receives a player input when said player touches one object in said set. The touch screen displays a symbol or numeric value corresponding to the randomly associated attribute for the touched object. The casino gaming machine randomly re-assigns the remaining attributes to the remaining objects that have not been touched in response to each touched object before the player touches the next object. The player plays a bonus game when the displayed symbol is a bonus game symbol. The casino gaming machine repeats the steps of receiving the player's input, displaying the hidden attribute of the touched object, and re-assigning attributes as long as the displayed symbols are numeric award values or after playing the bonus game. The casino game ends when a predetermined number of player inputs have occurred.

A method for playing a casino game in a casino gaming machine having a set of objects displayed in a touch screen of the casino gaming. Each displayed object having a randomly assigned attribute from a corresponding set of attributes. The set of attributes having numeric values and at least one bonus game play symbols. The casino gaming machine receiving a player input when the player touches one object in the set on the touch screen. The casino gaming machine displays in the touch screen a symbol or numeric value corresponding to the randomly associated attribute for the touched object. The casino gaming machine re-assigns the remaining attributes to the remaining objects that have not been touched in response to each touched object before the player touches the next object. The casino gaming machine repeating the steps of receiving, displaying, and re-assigning when the displayed symbol is a numeric award value. The player plays a bonus game when the displayed symbol is a bonus game symbol. In response to the player playing the bonus game, the casino gaming machine changes all remaining numeric value attributes in the set of attributes to stoppers and the machine repeats the steps of receiving, displaying, and re-assigning until the displayed symbol displayed is a stopper. When a stopper is displayed the game ends.

The summary set forth above is for several of the invention embodiments disclosed herein and does not limit the teachings of the invention especially as to variations and other embodiments not discussed above and as more fully set out in the following description taken in connection with the accompanying drawings.

BRIEF DESCRIPTION OF THE DRAWINGS

FIG. 4 sets forth the randomly assigned attributes for the number of trigger symbols displayed.

FIG. 5 illustrates the touching of one displayed trigger symbol in three aligned trigger symbols of a casino base game outcome by a player resulting in a GO display on the touch screen.

FIG. 6 illustrates a casino base game outcome with three scattered trigger symbols.

FIG. 7 illustrates a casino base game outcome with two trigger symbols on adjacent columns (reels).

FIG. 10 sets forth the hidden attributes associated with fifteen balls for one display of the INTRO bonus game.

FIG. 12 sets forth the player probabilities of playing the INTRO bonus game for the embodiment of FIG. 11.

FIG. 13 sets the hidden attributes associated with fifteen balls for a second embodiment of the INTRO bonus game.

FIG. 15 is a table setting forth the value population for one high lane of Pachinko Bonus Game #1.

FIG. 16 is a table setting forth the values for the remaining nine lanes of the Pachinko Bonus Game of FIG. 15.

FIG. 19 is a table of cloud values for Pachinko Bonus Game #2 of the invention.

FIG. 20 is a table of peek probabilities for the game of FIG. 19.

DETAILED DESCRIPTION OF THE INVENTION

Figure 1:
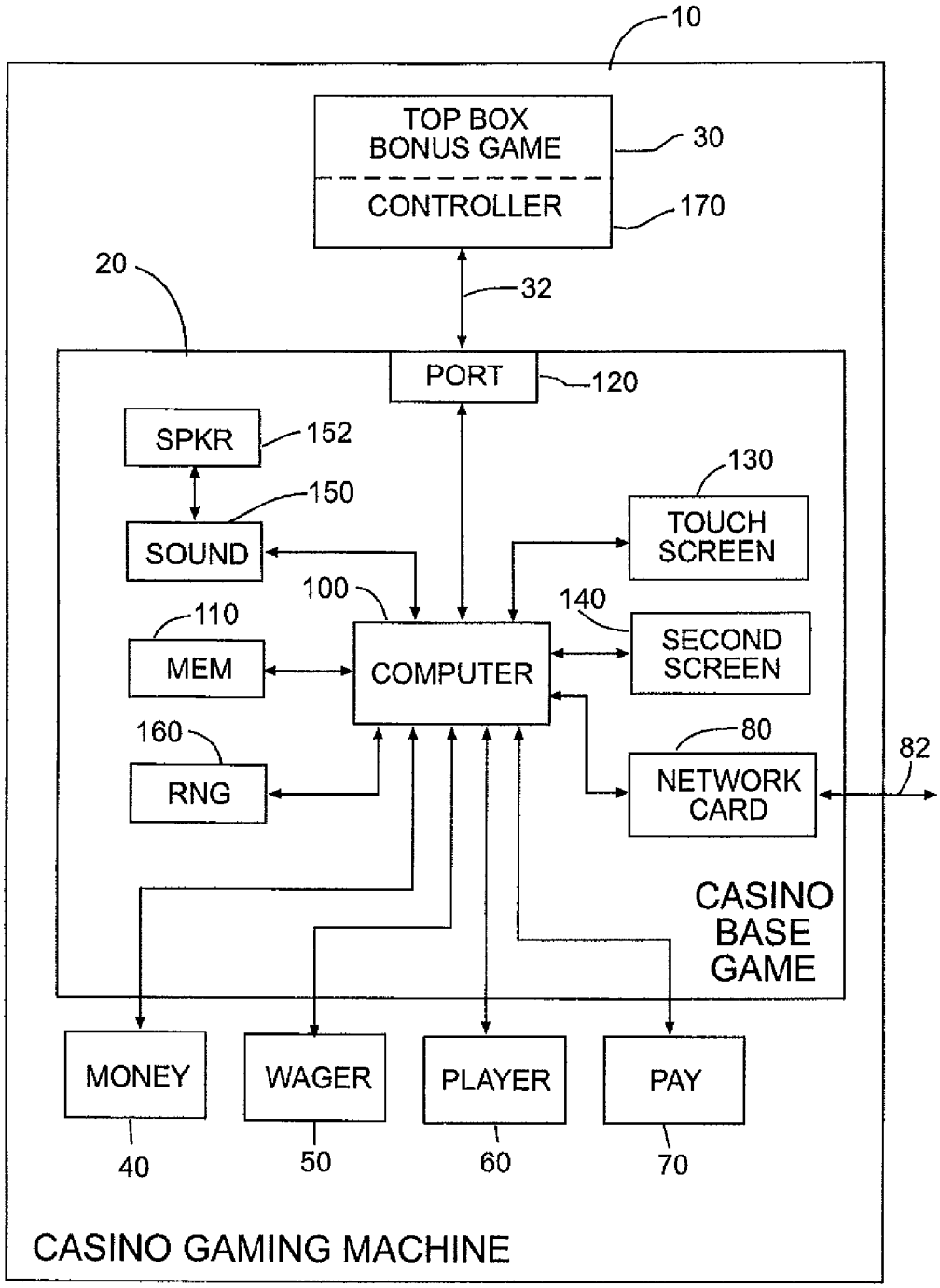
Fig. 1 ( Prior Art )
FIG. 1 (prior art) illustrates some of the functional components of a conventional casino game machine.

A prior art casino game machine 10 shown in FIG. 1 functionally comprises a casino base game component 20 and a top box bonus game component 30. The provision of a top box bonus game component 30 with a communication connection 32 to the casino base game component 20 is conventional.

The many conventional details for operating a casino game machine 10 are well understood in the industry, including receiving money, accepting wagers, delivering payoffs, operating a casino game machine, etc. In particular, a conventional money reception device(s) 40 such as a bill acceptor, ticket acceptor, or coin slot may be utilized. Too, such conventional wager device(s) 50 such as push-buttons or a touch-screen may be utilized to initiate play. Typically, players may have special player inputs (either physical 60 and/or on-touch-screen 130) that denote a max bet, spin of the reels, a bonus bet, etc. Likewise a conventional payout device(s) 70 such as a ticket dispenser, bill dispenser, coin dispenser, etc. or any suitable payout device or devices are possible. The casino base game 20 may communicate over a network card 80 with other casino game machines, computer systems, etc. over a bus 82.

A computer 100 is functionally interconnected to the money reception device(s) 40, interconnected to the wager device(s) 50, interconnected to the player wager input device(s) 60, interconnected to payout device(s) 70, interconnected to a memory or memories 110, and interconnected to the top-box bonus game 30 by way of a communications port 120. The computer 100 thus controls the casino base game 20 and the top box bonus game 30 in the casino gaming machine 10. In another embodiment, the computer 100 communicates with a top-box controller 170 which controls the top box bonus game 30. The computer 100 can be any type of one or more processors, microprocessors, controllers, gaming platforms, etc. suitably adapted for the casino game machine 10 as conventionally done in the gaming industry. The computer 100 is also connected to a touch-screen 130 and/or a second screen 140. The various methods of base game and bonus game play described herein are conventionally programmed into memory 110 so that the computer 100 can implement the teachings contained herein.

Conventionally, the general functional configuration shown in FIG. 1 of the gaming device preferably includes a computer memory device(s) 110 for storing program code or other data, main display device 130, optional secondary display device(s) 140, sound card 160, speaker(s) 162 and one or more player input devices such as a touch screen 130. The computer 100 functionally displays images, symbols and other indicia such as the faces and backs of cards and/or a wide variety of gaming symbols either itself or through communication with a graphics card or a graphics controller. The memory device 110 can include random access memory (RAM) for saving or accessing game data generated or used during a game. The memory device 110 can also include read only memory (ROM) for storing program code which controls the casino gaming machine 10 so that a particular game(s), such as the game(s) of the invention, is loaded and plays in accordance with appropriate game rules and paytables. Although the computer 100 and memory device 110 preferably reside on each casino game machine 10, it is also possible to provide at least some of their functionality at a central location such as a network server for communication to a playing station such as over a network 82 local area network (LAN), wide area network (WAN), Internet connection or other wireless link such as through a network card 80. With regard to generating random events from a random number generator 160 (e.g., the dealing of cards), it is possible for this to occur locally (e.g., at or within the gaming device) or non-locally (e.g., centrally at a server accessed by wire or wirelessly) or a combination thereof. The random number generator 160 can be a separate component or implemented in software in memory 110. At least some or all of the above are functionally found in hardware, firmware, and software of conventionally available gaming platforms.

The conventional casino base machine 20 also includes a base slot platform, which may be video or mechanical (stepper). For purposes of the present invention, in one embodiment, the casino base game 20 is a multi-reel, multi-line video presentation on a conventional touch-screen 130. Many conventional products of such multi-reel, multi-line casino games are known.

One embodiment of the invention is a video based game with a touch screen 130 in a traditional 5×3 (5 reels×3 symbols appearing within the "window") format with 30 paylines and an additional buy-a-pay wager. The player may wager in increments of 1-coin per line, and the buy-a-pay Bonus Bet is equal to ⅓ of the total 30-line bet. While this embodiment has 30 paylines in a 5×3 video format, it is to be expressly understood that any number of reels and any number of pay lines could be utilized in a video or mechanical form to implement the teachings of the invention as presented herein. Similarly, the use of a "Bonus Bet" feature, as will be discussed later, is a design choice and need not be present.

In one embodiment, the top box 30 of the invention houses a bonus game of a mechanical free-motion type. The mechanical Pachinko top box has a playfield of deflecting pins and free motion balls that are delivered to the top of the playfield, bounce and ultimately fall through one of ten lanes, is utilized for play of the bonus games. On a display either behind, immediately below the lanes or otherwise associated with the lanes, the lane values and/or lane symbols are displayed. See U.S. Pat. Nos. for Pachinko casino games having these features: U.S. Pat. Nos. 6,896,261 and 6,851,674.

In another embodiment, a video representation of the top box bonus game can be incorporated into a second-screen of the same base screen 130, so as to eliminate the additional structure and cost associated with a top box 30. In addition, multiple bonus games either on the base game 20 or within the top box 30 can be utilized under the teachings of the invention, without the need for additional hardware. Preferably, the casino base game 20 communicates 32 with a top box controller 170 during game play, in order to send instructions and data to the top box 30, receive results and data back from the top box 30, etc. as is conventional in the gaming industry.

Finally, it is understood that the casino games and methods of the invention herein can be implemented in consumer computer systems such as Apple MAC computers and/or over the Internet.

Figure 2:
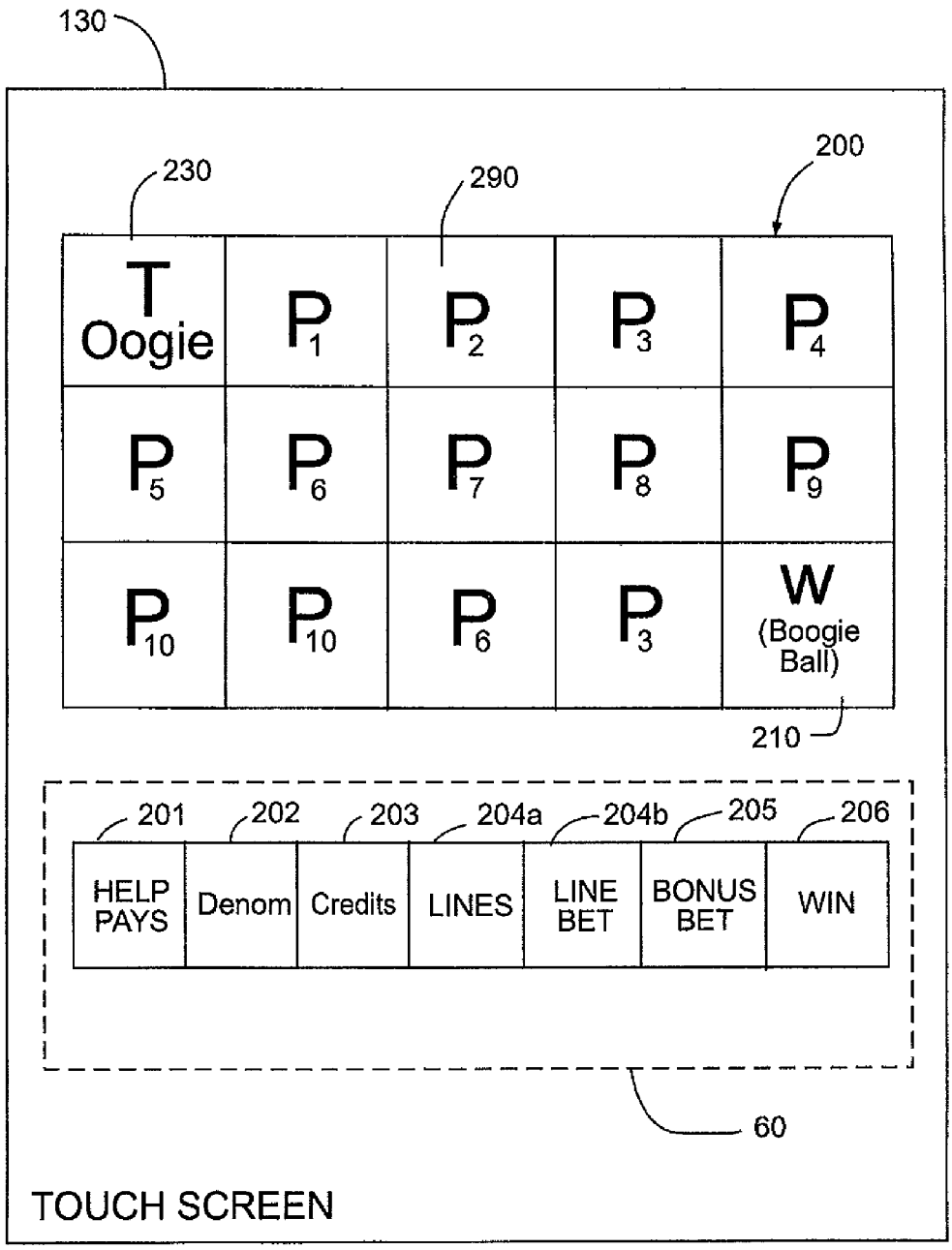
FIG. 2 illustrates a touch screen displaying a 5×3 game display (five reels, three symbols shown per reel) and a series of touch screen inputs.

Casino Base Game 20: For the base game played in the casino base game 20 the format is video, with a base screen of 5 columns and 3 rows (5×3) 200 in touch screen 130, wagering upon 30 paylines in increments of 1-coin per line and "buy-a-pay" as illustrated in FIG. 2. Buy-a-pay is an arrangement whereby a subset of payoffs must be "bought" in order to be active. Historically used on mechanical slots, for example, a first coin would buy a set of "cherry" pays, the second a set of "bar" pays, and the third a set of "7" pays. For example, a player playing one coin and hitting 7-7-7 would not get paid on such a machine. The "buy-a-pay" formats are used on video slots now as well, in order to offer access to payoffs, features or bonus games that otherwise would not take place.

On the touch-screen 130 shown in FIG. 2, on the bottom of the screen starting on the left and going across are the following touch buttons and/or boxes appear: Help/Pays button 201, Denom icon (going to denomination selection screen if touched) 202, Credits Box (toggling with Cash Box if touched) 203, Lines Box 204*a*, Line Bet Box 204*b*, Bonus Bet (Groovy) Box 205 and Win (Paid) Box 206. Except for the Win Box 206, these all comprise player inputs shown in FIG. 1 from the touch screen 130 when touched by the player.

The "Bonus Bet" feature 205 is ⅓ of total 30-line bet if wagering upon all 30 lines. In one embodiment, the Bonus Bet purchases (1) an additional pick for the player when aligning the correct number of base screen triggers in the base game play outcome (roughly doubling the frequency of bonus games), and (2) with three base game triggers, awards the player all trigger awards if the bonus game is picked on the first try. In principle, the Bonus Bet need not be utilized under the teachings herein, or might be utilized in a different manner. In one embodiment, the Bonus Bet 205 is known as the Groovy Bet and pays for any combination of two scattered triggers in the base game outcome, the combination of two scattered triggers otherwise paying nothing if the Groovy Bet is not made. With the Groovy Bet 205, if the two trigger symbols appear on adjacent reels, the player chooses one of the triggers—one of the two triggers immediately launches a second-screen Pachinko bonus game, the other gives a numeric award; if two trigger symbols appear on nonadjacent reels, a different numeric award is given.

The base slot machine game 20 includes twelve different types of play symbols: one wild symbol (W) 210, ten different themed symbols (P) 220 and one trigger (T) symbol 230. The triggers 230 preferably are blue ball characters affectionately known as "Oogie" which animate in a video sequence so as to "come to life" upon achieving a winning combination. The wild symbol 210 is a logo comprising the name of the game "Boogie Ball". Any theme or set of names could be used for the trigger and wild symbols 210 and 230.

Initiation of Bonus Games: In one embodiment of the invention, one "set" of triggers 230 is utilized. A bonus is initiated when a predetermined number of trigger symbols 230 are aligned within the 5×3 window 200 in screen 130. In some alignments, the player directly (preferably via touching directly on the base touch 130) selects one or more of the actual trigger symbols, which either reveal an attribute that launches a bonus game (advancing the player to a second-screen displayed in the touch screen 130) or reveals an attribute that has a numerical value. Under the teachings of the invention, the player plays this bonus initiation game by choosing trigger symbols 230 that reveal either numerical awards or that launch Pachinko bonus games.

The following sets forth two basic versions of triggering symbol arrangements in the base game outcome.

Figure 3:
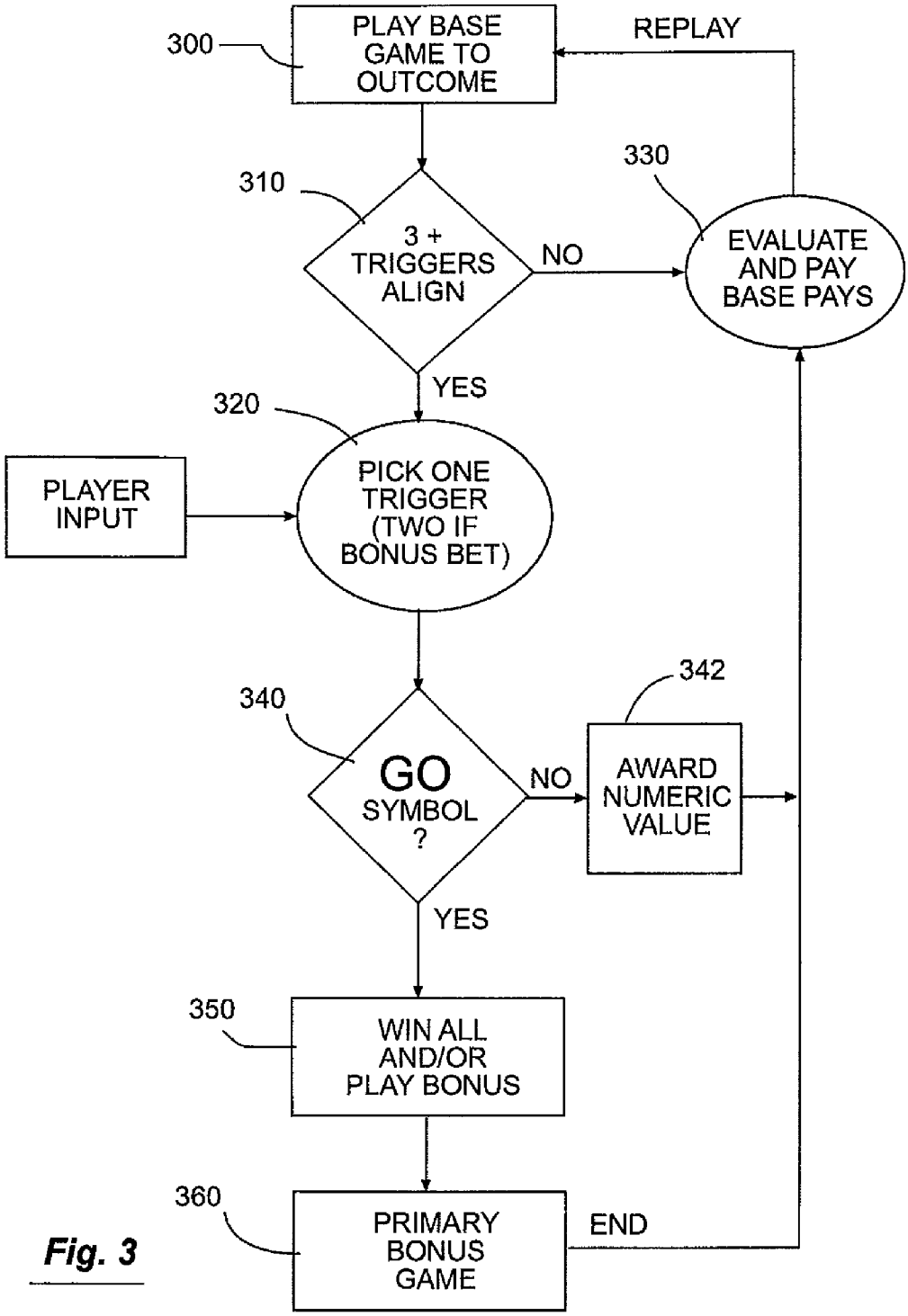
FIG. 3 is a flow chart of the invention showing casino base game into bonus game play when trigger events occur.

Version 1 (Three or More Trigger Symbols): As shown in FIG. 3, play of the casino base game 20 (step 300) results in a random base game outcome as conventionally produced in the casino game machine 10. When three or more trigger symbols 230 appear in the outcome in display 200 in step 310, then a dual-stage qualification takes place on the display 200 in stage 320.

In the first stage 310, three or more trigger symbols 230 (blue ball "Oogie" characters, denoted as symbol "T" for trigger) must appear anywhere on the reels in the 5×3 game outcome. Fewer or more trigger symbols, arranged in different configurations, may be required to trigger the bonus in other embodiments of the invention.

Three scattered trigger symbols 230 as the result of the base game machine spin, are shown in FIG. 5, comprises the first stage 310. Once three or more trigger symbols 230 appear, then in the second stage 320 the player is prompted to pick one trigger 230 by touching the symbol directly on the touch screen 130 (if the Bonus Bet is made, the player picks two triggers). Thereafter, the picked trigger (Oogie) 230 animates by shooting a "popper" 500 toward the player, on the screen 130, to reveal either a green "GO" symbol or a numerical award (collectively, termed "attributes"). The "GO" symbol may be any symbol, but is preferably one that implies success in terms of player selection from among the triggers. That is, it implies superiority compared to the numerical values. In principle, other animations or methods of revealing whether or not the trigger qualifies the player for the primary bonus game are possible. In the preferred embodiment, the "attributes" (either "GO" or a numerical award) are randomly assigned to the trigger (Oogie) symbols 230, as set forth in FIG. 4. The term "attribute" is mathematically used to be an object having value to the player such objects denoting: bonus game play (such as initiating or continuing on to play a bonus game), bonus game enhancement (such as giving the player extra picks, extra chances, or an increased multiplier), base game enhancement (such as giving the player free spins), numeric values (such as $3 or 3× for 3 times the waged units), bonus game modifiers (such as +3 picks or +3 spins), prizes (such as a car), etc.

The three triggers 230 are randomly assigned conventionally by the casino gaming platform in the casino game machine 10 to form one set of possible attributes from FIG. 4 such as {35×, 70×, "GO"} or {GO, 40×100×}, etc. for the displayed trigger symbols of FIG. 5. The "GO" attribute will always be assigned to one of the three triggers. These are not known to the player but are shown in dotted lines in FIG. 5. If in stage 320, the player touches the trigger 230 having the hidden 35× attribute of FIG. 5, the player has not received a "GO" in step 340 and receives 35 times the wager in step 342 to award the numeric value displayed. The player can re-wager and play the base game again in step 300. If the player, however, touches the trigger 230 having the hidden "GO" attribute in step 320, the symbol animates to reveal a "GO" symbol 500 as shown in FIG. 5. The bonus game initiates in step 350.

In one embodiment, all numerical values are premultiplied by the initiating line bet. For example in FIG. 5 with the player touching the trigger revealing the 35× attribute, if the initiating bet were 160 credits (30 lines×4 credits per line plus Bonus Bet of 40 credits), then the 35× would be revealed as "140" equal to 35×4 credits per line (the Bonus Bet is not counted toward this calculation).

In one embodiment, if no Bonus Bet is made (so the player only gets 1 pick) in step 320 the remaining unpicked triggers 230 are not revealed. However, as a design choice in other embodiments, they may be revealed.

If the Bonus Bet 205 is made (so the player gets 2 picks in stage 320) then if three triggers are displayed and first pick is "GO" the player, in one embodiment, wins all three awards (remaining numerical values revealed upon return to base screen after initiating and returning from bonus game). In one embodiment, an attribute potentially affecting or modifying the bonus game ("bonus game modifier") is hidden behind the triggers which don't have a GO symbol. For example, if the GO symbol launches a bonus game where the player gets 5 picks, then the other triggers may hide a numeric award or hide an attribute such as "+3 picks" which, if found before choosing GO, would initiate the ensuing bonus game with 8 picks (5+3).

Otherwise, regardless of number of initiating aligned triggers, prior to the second player pick, in one embodiment the remaining attributes for the triggers are rotated and/or randomized as illustrated later. In rotating the attributes, e.g., for 5 triggers in which the player selected the trigger on the 2nd reel, the attribute of each unselected trigger would be moved to a neighboring trigger, in a prescribed manner. For example, the 1st trigger's original value would be moved to the 3rd trigger, the 3rd trigger's original value would be moved to the 4th trigger, etc. In this way, each trigger's attribute has been rotated between picks. In addition, in a preferred embodiment, the highest remaining numerical value is modified by increasing it 30× for 3 triggers, 100× for 4 triggers, or 250× for 5 triggers. Of course, other modifications are possible, for example 10× for the lowest remaining numerical value, etc. In another embodiment, the attributes are randomized, or rotated among the triggers, but are not modified. In another embodiment, the attributes, once assigned, remain associated with the respective triggers and are not randomized, rotated or modified. In still another embodiment, the attributes are randomized or rotated only one time after a specific pick (e.g., after the first player pick, or prior to the last player pick). In another embodiment, the randomizing or rotating takes place only among the numeric values.

The presence of the popping to a GO symbol 500 in step 340 initiates the PRIMARY Bonus game 350. The PRIMARY Bonus game includes an INTRO Bonus Game which serves as a hub (as applicable) to one of three Pachinko-themed Bonus Game (either Pachinko Bonus #1, Pachinko Bonus #2 or Pachinko Bonus #3) as will be further explained. In this embodiment, the GO initiates the Primary Bonus.

The term aligning as used herein includes triggers appearing anywhere in the reel spin outcome.

These two stages, of aligning a predetermined number of triggers, and picking to find the one or more triggers that are associated with the "GO" attribute, take place on the base touch screen 130.

Figure 8:
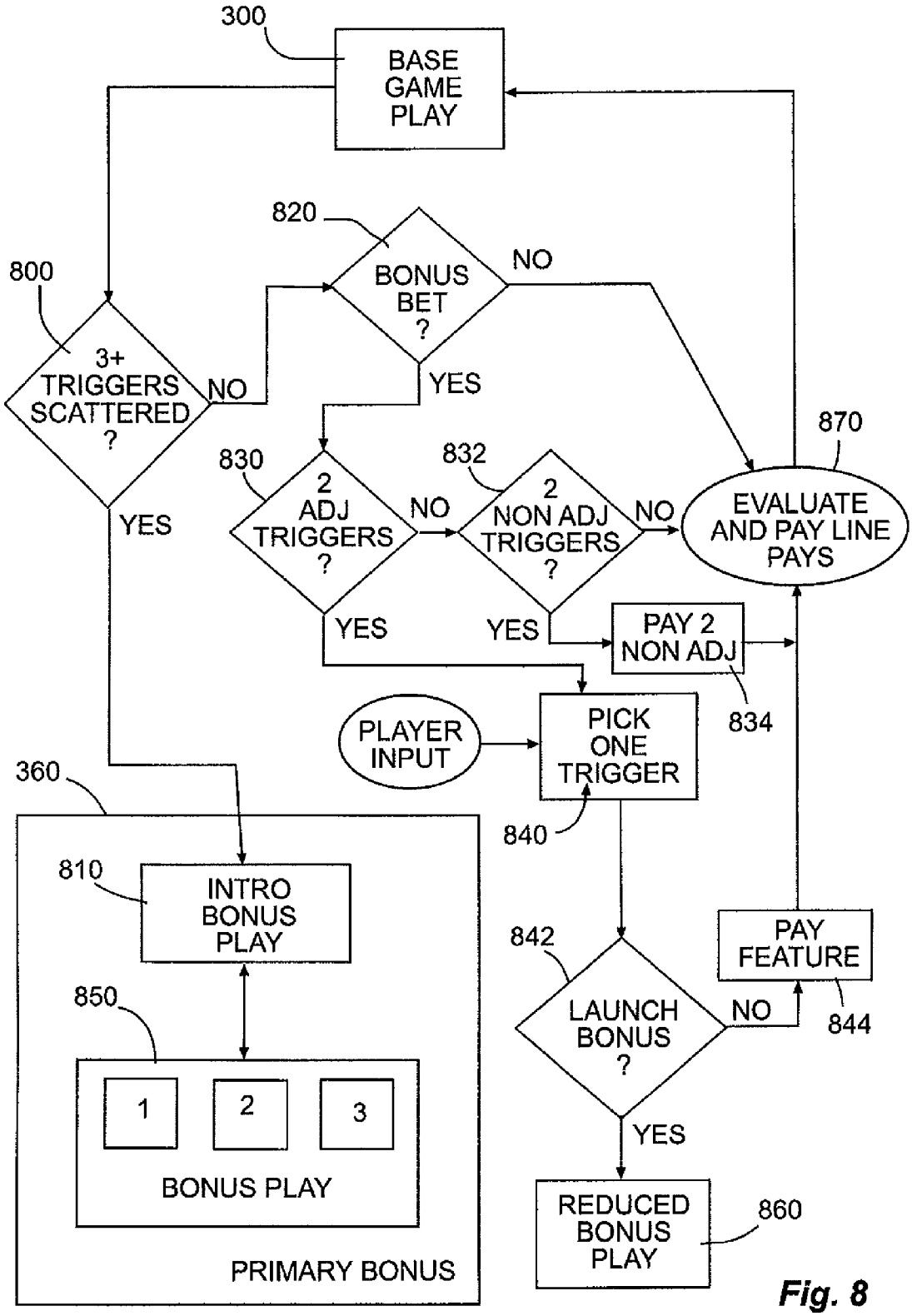
FIG. 8 is a flow chart of the invention showing game play when trigger events occur in the base game outcome.

Version 2: FIG. 8 sets forth the steps of play when: (a) three or more scattered trigger symbols 230 appear in the base game outcome reels 200 of FIG. 6, or (b) if making the Bonus Bet 205, a dual-stage qualification beginning with two trigger symbols 230 on adjacent reels as shown in FIG. 7.

(a) Three or more scattered triggers:

Three or more triggers 230 as shown, for example, in FIG. 6 in step 800 launches the full-fledged PRIMARY bonus game 360, beginning with the INTRO Bonus 810, which serves as a conduit to one or more Pachinko-themed Bonus Games (either Pachinko Bonus #1—The Big One, Pachinko Bonus #2—Double or Nothing (DoN) Heaven, or Pachinko Bonus #3—Drop, Spin & Win). When three or more triggers appear, then step 800 delivers the player to play the primary bonus 360.

(b) When less than three triggers appear, the step 800 enters stage 820 to determine if the Bonus Bet has been made.

In the first stage 830, two trigger symbols 230 (and only 2, not 3 or more) on adjacent reels (blue ball "Oogie" character 230) must appear anywhere on the reels as shown in FIG. 7. Once appearing, the Oogie characters 230 are highlighted, and in the second stage 840 the player is prompted to "Choose Your Oogie!" directly on the reels (pick one trigger). Thereafter in stage 842, Oogie animates either (i) by shooting a "popper" 500 toward the player (launching Bonus #1, #2 or #3 in stage 860) based on the image revealed in step 842, or (ii) by not shooting a popper 500 but revealing a numerical value, as follows, for two triggers on adjacent reels with a Bonus Bet 205 for pay in step 844. Here, one adjacent trigger symbol 230 associated with the popper would have randomly associated with it one of three different logos 500 corresponding to the different Bonus Games with the following percentages of occurrences: (41% Pachinko Bonus #1, 28% Pachinko Bonus #2, 31% Pachinko Bonus #3). The other adjacent trigger symbol 230 would have randomly associated with it one of the following numerical awards: (12% 50×, 15% 65×, 17% 75×, 16% 80×, 14% 85×, 15% 100×, 11% 125× line wager). Any suitable number of bonuses, numeric awards, and percentages can be utilized under the teaches herein. The above is by way of illustration only.

If the two triggers are not adjacent in stage 830, then stage 832 is entered to determine if there are two triggers. If not two triggers, then stage 870 is entered. If there are two non-adjacent triggers, stage 834 pays an additional award before entering stage 870.

In addition, the orientation of the two adjacent trigger symbols 230 (for example, $1^{st}$ reel top and $2^{nd}$ reel bottom, or $2^{nd}$ reel middle and $3^{rd}$ reel middle, etc.) may also be utilized to determine which of the different Bonus Games occurs if the player selects the trigger symbol 230 associated with the popper. Counting the 4 pairs of adjacent reels (1,2; 2,3; 3,4; 4,5) and nine relative positions (top, middle, bottom for each reel), there are therefore 36 possible orientations.

All numerical value attributes are premultiplied by the initiating line bet. For example, if the initiating bet were 160 credits (30 lines×4 credits per line plus Bonus Bet of 40 credits), then the 50× numeric value attribute would be revealed as "200" equal to 50×4 credits per line (the Bonus Bet itself is not counted toward this calculation). The average numerical award is equal to 82×.

So in this version, three or more scattered triggers (FIG. 6) in step 800 launches the PRIMARY bonus game which includes the INTRO bonus game 810, which in turn launches in stage 850 one or more bonus games known as Bonus #1, Bonus #2 and Bonus #3. Otherwise (with the Bonus Bet 820), two adjacent reel triggers (FIG. 7) cause a feature to initiate on the base game wherein the player chooses one of the two adjacent trigger symbols in step 840. The correct trigger (one of the two hides a popper and the other has a numeric value) immediately launches in step 842 a bonus game 860, with game play similar to Bonus #1, Bonus #2 or Bonus #3. If a numeric value is revealed it is paid in step 844. In a preferred embodiment, the 2-trigger form of the Bonus game is a "reduced" form of that which may be awarded through the INTRO bonus game discussed next. In another embodiment, the 2-trigger Bonus game may be different from other possible bonus games, so that the player must make an extra wager (the Bonus Bet) in order to experience the 2-trigger Bonus game.

INTRO Bonus Game (Ball Bonus Game): As mentioned with respect to FIGS. 3 and 8, when the player enters the PRIMARY bonus game 360, the INTRO bonus game is played 810. There are two versions of INTRO bonus play 810.

Figure 11:
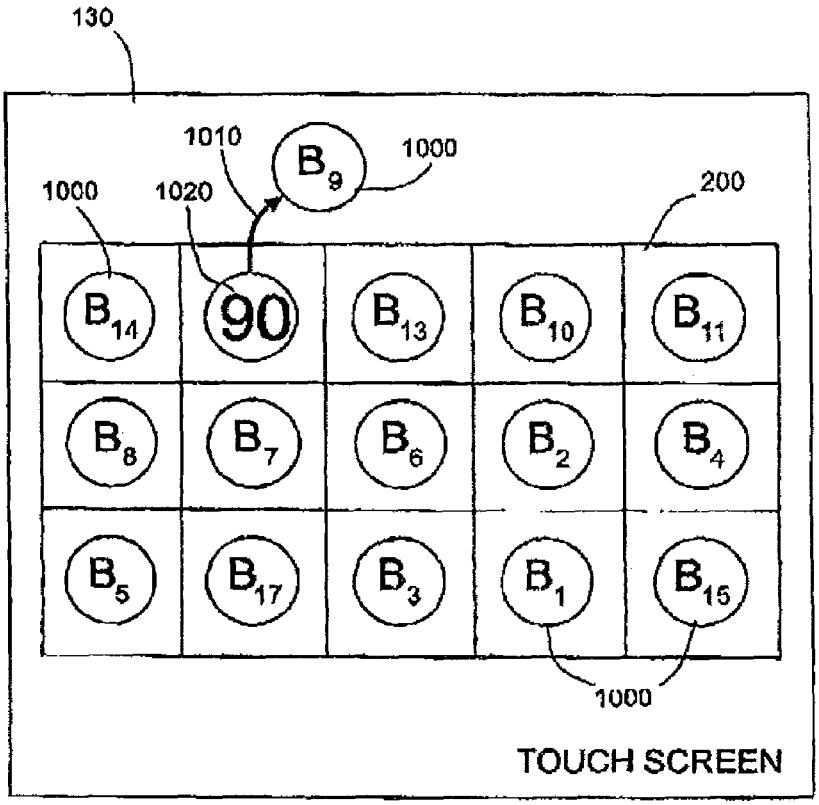
FIG. 11 illustrates an INTRO game display of fifteen balls corresponding to FIG. 10 having randomly assigned hidden attributes associated therewith.

Version 1: On a second-screen in touch screen 130, the player is prompted in the INTRO bonus game to make 5 picks from 15 randomly displayed colorful balls (B1-B15) in step 900 of FIG. 9. As shown in FIG. 11, each ball 1000 in the 5×3 grid is different (e.g., colors, with stars, candy-stripes, etc.) and "bounces" off to reveal its hidden value 1020 when touched by the player on the touch screen 130. The 15 balls hide attributes of 12 numerical values and 3 bonus initiators, placed randomly, as shown in FIG. 10. Values are premultiplied by the initiating line bet, E.g., in FIG. 11, the player touches ball B9 having the attribute numerical value of 30×, which for an initiating bet of 3 units per line, would bounce off to reveal a value "90" units (1020 in FIG. 11) to the player. After each pick, the top remaining numerical award in the attributes of FIG. 10 is increased (for 3 Triggers, 4 Triggers, 5 Triggers, the increment is 15×, 35×, 50×). As used herein, the terms "trig" or "trigs" shall mean "trigger" and "triggers" respectively. For 3 triggers, with 30× picked, then 75× would be increased in step 940 by 15× to 90×.

Additionally, all remaining attributes (whether numerical or initiating Pachinko bonus) are again randomized and reassigned in step 950 to the balls B (in another embodiment, these values remain fixedly associated with the balls B throughout the INTRO Game or are rotated as discussed above). As the player has 5 picks, (regardless of initiating triggers) there is always a numerical award which is incremented prior to the 2nd through 5th picks. With each numerical value picked, the Bonus Win meter is incremented by the corresponding number of credits before the next player pick.

With this play method, the player has the opportunity to win multiple Pachinko bonus games, as shown in FIG. 12 which summarizes the probabilities of playing 0, 1, 2, or 3 Pachinko bonus games.

Figure 9:
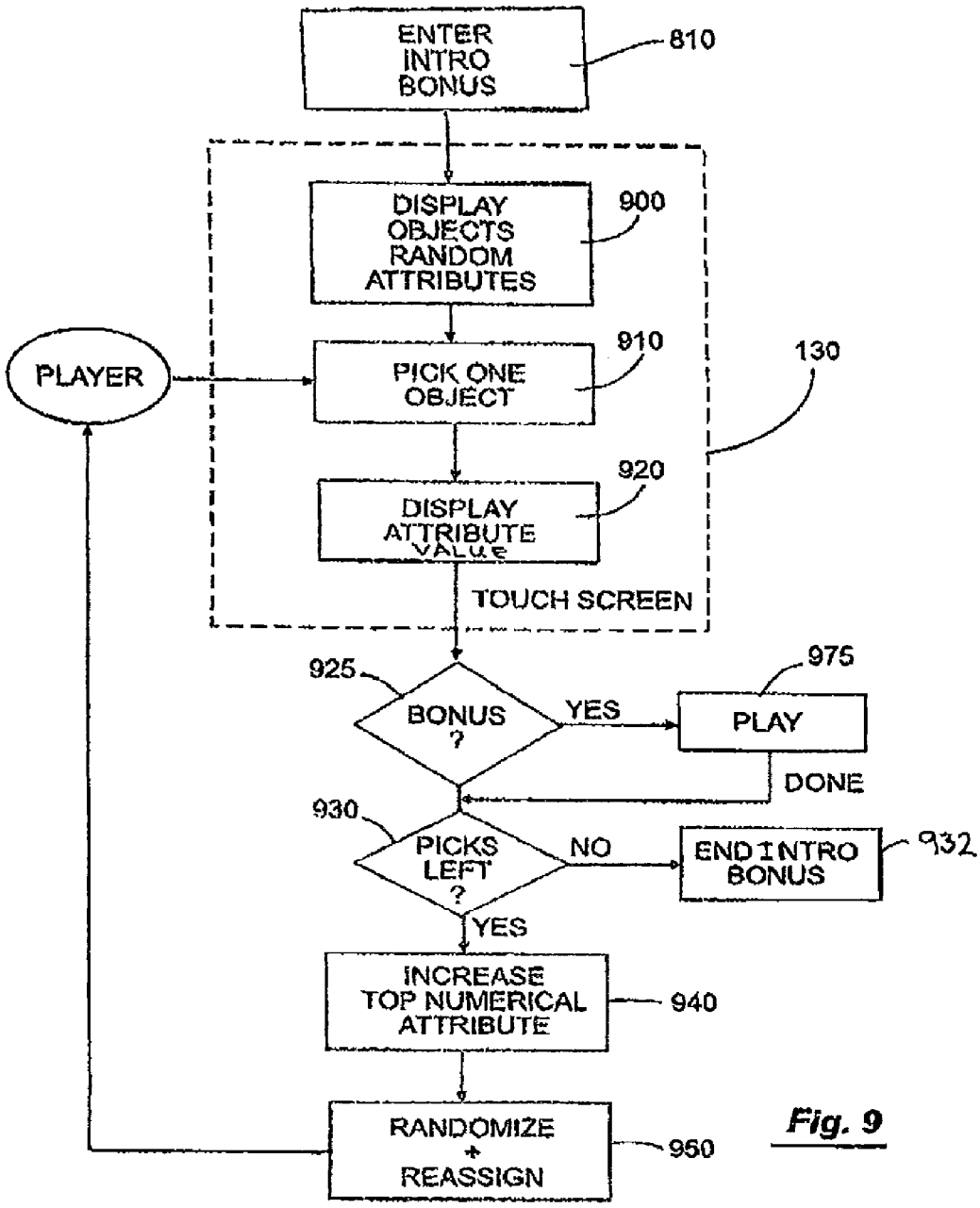
FIG. 9 is a flow chart of the invention showing INTRO bonus play for a first embodiment from the casino base game outcome and before playing a bonus game.

In summary and with reference to FIG. 9, the player is presented in step 900 with a casino game in stage 810 with a display 200 of objects 1000 in touch screen 130. The ball display 200 shown in FIG. 11 is a matrix of three rows and five columns, but the ball display 200 can be any other matrix configuration or any display 200 whatsoever of objects 1000. For example, the objects 1000 could be apples hanging in a tree shown in display 130. Any suitable theme can be implemented. The objects 1000 comprise a set {B1, B2 . . . Bn} and n can be 15 as shown or any other suitable number. FIG. 10 shows the attributes (values, bonus game plays) for the set {B1, B2 . . . B15} of FIG. 11. The attributes as shown in FIG. 10 may be different based upon events occurring in prior casino game play such as how many triggers occurred in the base game outcome. The above discussion provides three triggers. The number of triggers, based on game design, can be more or less than three, including not using triggers at all or initiation by some other random means. The attributes for the appearances of 4 and 5 triggers appearing in the base game outcome are shown in FIG. 10. The term "trigger" means the occurrence of special symbols appearing in a reel slot matrix (e.g., FIG. 6), but also the appearance of symbols in other than reel slot matrix such as by secondary device. Triggering may also be accomplished randomly without the use of symbols and may occur external to the machine—e.g., in a linked or server based system.

Based upon the trigger occurrence, the player is given a number, P, of picks—that is, the player touches a number of objects 1000 such as five in the example above. Under the invention, the number P can be any suitable number. After the player picks 910 an object 1000 by touching on touch screen 130, the base game machine reveals and displays the attribute associated with the touched object 1000 in step 920. If the attribute is numeric, the win meter is advanced. If the attribute is a bonus feature in step 925, then the player plays the bonus feature 975 and returns to pick the next object 1000 when done.

If the predetermined number of picks P have not been used in step 930, then the base game machine increases the top remaining numerical award in the attributes for the set B of objects corresponding to the number of triggers in step 940 and re-randomizes the increased set of attributes to and re-assigns the attributes to the displayed objects in set B in step 950. The player then touches 910 the next object 1000 to reveal its new re-assigned attribute. The above process repeats after each picked object 1000 in stage 910 until the number P is reached in step 930 and the INTRO bonus ends in step 932. In this version, a set of attributes corresponding to the set of objects 1000 is stored in memory 110. When the casino game 810 is entered, the computer 100 (through operating software based on the above) uses the random number generator 160 to randomly assign the attributes to the objects 1000. In response to a player touching 60 the screen 130 for a picked object 1000, the computer 100 displays the attribute for the touched object and then repeats the above process for each additional allowed player pick until the predetermined number P is reached. Note that the step 950 of re-randomizing may be done before or after the step of increasing the highest numeric award and either step may be optional in certain embodiments. In the actual game, the balls themselves are not shuffled or randomized on-screen, it is only the hidden values that are randomized "behind the scenes".

Version 2: On-screen, when the player enters the INTRO bonus 810 in FIG. 14, the player is prompted to make picks in stage 1410 from 15 colorful balls, preferably utilizing two distinct color patterns appearing in display 130 in stage 1400. The 15 balls hide 12 numerical values and 3 bonus games, placed randomly, as shown in FIG. 10 (all multipliers× line bet) for the appearances of three triggers, four triggers, and five triggers in the bas game reel outcome.

The hidden attribute for the picked object is displayed in stage 1420. Values are premultiplied by the initiating line bet. E.g., the numerical value of 30× for three triggers, for an initiating bet of 3 units per line, would actually show "90" units to the player in step 1420. With each numerical value chosen, the Bonus Win meter is incremented by the corresponding number of credits. After each pick, the top remaining numerical award remaining (if any) is increased (for 3 Trigs, 4 Trigs, 5 Trigs, the increment is 5×, 10×, 25×) in stage 1430. Additionally, all remaining values (whether numerical or initiating Pachinko bonus) are again randomized and reassigned to the balls in stage 1440.

The player continually picks from stage 1450 as long as numeric values are displayed in stage 1420, with no stoppers, until selecting one of the hidden Pachinko ball symbols for bonus game play. As the Pachinko ball is not a stopper in stage 1460, the appropriate Pachinko bonus game is played 1470. Thereafter, upon returning to the INTRO Bonus screen, the remaining numeric value attributes are changed to become stoppers in stage 1480. The player resumes picking objects in stage 1410 until the first stopper is revealed and in stage 1460 ends 1462 the casino game. Note that the first Pachinko ball revealed in stage 1420 does two things—it initiates a Pachinko bonus game play, and it triggers the remaining numeric values to become stoppers. If the player picks another Pachinko ball in 1410 (after all numeric values are changed to stoppers) the player plays 1470 this bonus game. In this way, the player is assured of always playing at least one Pachinko game and may play several.

With this play method, the player has the following probabilities of playing 1 (probability 0.8000), 2 (probability 0.1715), or 3 (probability 0.0286) Pachinko games. The average number of Pachinko games is 1.229.

An Entry Award may be given to the player upon entering the INTRO Bonus screen. In a preferred embodiment, there is no Entry Award for initiation by 3 scattered triggers. The Entry Award is 200× line bet for initiation by 4 scattered triggers, and 500× line bet for initiation by 5 scattered triggers.

In addition, should the player choose every ball on the INTRO Bonus screen (accomplished either by choosing 12 numeric values followed by the 3 Pachinko balls, or by choosing 11 numeric values followed by 3 Pachinko balls and then the final numeric value), the player is awarded 2,000× line bet as an All Clear Super Bonus.

The probability of clearing every ball in this way is 1 in 227.5, making the potential Super Bonus worth an average of 8.79× line bet per visit to the INTRO Bonus.

The average numerical award for the INTRO Bonus is as follows:

Numerical EV(INTRO, 3 Trigs)=140.82×+8.79×= 149.61× line bet.

Numerical EV(INTRO, 4 Trigs)=438.28×+8.79×= 447.07× line bet.

Numerical EV(INTRO, 5 Trigs)=1370.55×+8.79×= 1379.34× line bet.

While two methods of playing an INTRO bonus game have been presented, other embodiments are possible including the modification of picks, picking until selecting a Pachinko bonus game, picking until selecting a Pachinko bonus game and then being awarded one final pick, etc.

In another preferred embodiment, the objects' possible attributes include numeric values and bonus plays, as described above, but also bonus modifiers. For example, considering the three bonus play attributes (initiating Pachinko 1, Pachinko 2 or Pachinko 3 as described herein), the bonus modifiers may include one modifier that is particular to each bonus. For Pachinko 1, the bonus-specific modifier may be a "Re-do Ball Drop" if the player is dissatisfied with the results of Pachinko 1, or "Double Ball Drop" for example which affords the player 2 ball drops instead of 1. For Pachinko 2, the bonus-specific modifier may be a "Save" for the Double-or-Nothing portion, as described later herein, or "Award All" which during the cloud portion of the bonus automatically awards the player all of the cloud values without the player needing to find the All cloud. For Pachinko 3, the bonus-specific modifier may be "Start Multiplier 2×" which automatically starts the bonus multiplier at 2× instead of the usual 1×, or "3 Free Drops" which, for the first 3 ball drops, does not add an End lane thus helping the player. Note that the bonus modifiers may be bonus-specific. For example, a player finding "3 Free Drops" but ultimately not playing Pachinko 3, would not be able to use the "3 Free Drops" modifier, although in one embodiment, unused modifiers may be saved or pay a numeric value if expiring unused. The modifiers may also be bonus-generic. An example of bonus-generic modifier is a "Bonus ×2" which automatically doubles the win from the next, or all, bonus games.

As used herein, an attribute in addition to an award or bonus also includes a characteristic or property associated with an award or bonus. For example, an award of "100 credits" is a numeric attribute. A "Start Bonus" or "Bonus Play" is also an attribute, since it initiates a bonus game. A special type of attribute is referred to herein as a bonus modifier. This type of attribute may be collected by the player and function to modify an ensuing bonus game in favor of the player. The bonus modifier serves to enhance the bonus experience in some manner, preferably by altering the rules of the bonus game to further favor the player.

For example in the ball screen of FIG. 11, by way of example, we assume 9 balls have numeric values of 20, 40, 60, 80, 100, 125, 150, 175, 200, 1 ball has a bonus modifier of The Big One "Extra Ball Drop", 1 ball has a bonus modifier of DoN "Save", 1 ball has a bonus modifier of DSW (Drop, Spin, Win—Pachinko Game #3) "Start Bonus Multiplier at 2×", and the remaining 3 balls start the pachinko bonus games, "Start The Big One", "Start DoN", "Start DSW". Each ball, at the beginning, has one attribute—either a numeric award, a bonus modifier or a bonus initiator. Under the teachings herein, the player may, in choosing balls, encounter the following sequence in FIG. 14 as a result of picking in stage 1410: 100, 175, 40, "Start Bonus Multiplier at 2×", 20, "Extra Ball Drop", "Start The Big One". The last ball chosen initiates The Big One bonus game, which normally would afford the player a single ball drop to determine the award. However, since the player had previously chosen a ball with the bonus modifier for The Big One of "Extra Ball Drop", the bonus game is modified: the player gets 2 ball drops instead of just 1 ball drop, during play of The Big One. Upon returning to the Ball screen of FIG. 11, the balls with numeric values take on the additional attribute of becoming stoppers in stage 1480. However, in a preferred embodiment the balls with bonus initiator attributes or bonus modification attributes do not become stoppers. So, the player may, for example if choosing "Start DSW" play another bonus game, in this case an enhanced form of DSW where the Bonus Multiplier starts at 2× instead of the customary 1×. Upon choosing the next ball showing a numeric award, the bonus game would be over.

Figure 14:
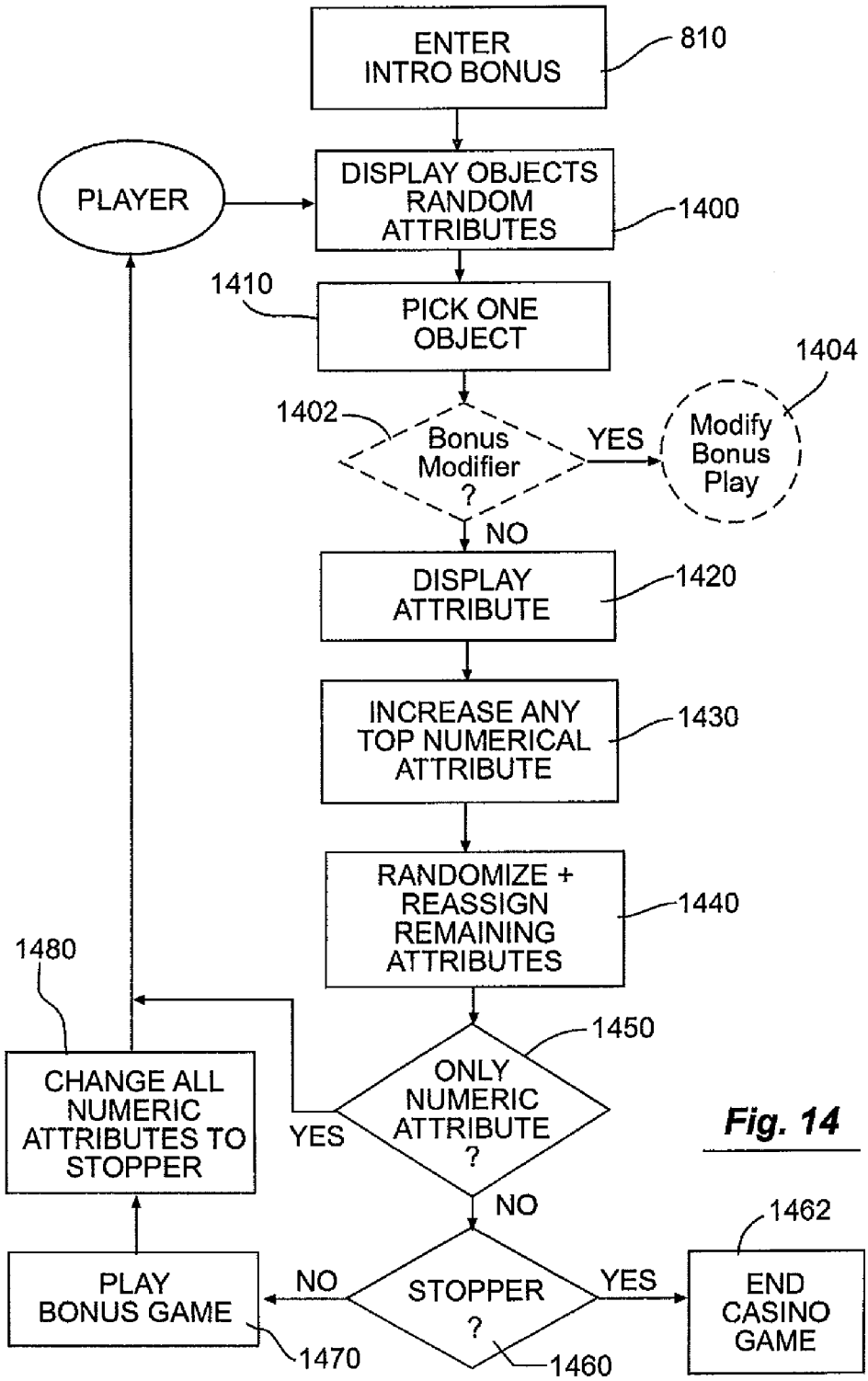
FIG. 14 is a flow chart of the invention showing INTRO bonus game play for a second embodiment of FIG. 13 from the casino base game outcome and before playing a bonus game.

In summary, and as shown in FIG. 14, the casino bonus game is entered 810 and the set of objects B (15 in the example) are displayed 1400 in the 5×3 reel display 200. Associated with the set of objects B are a corresponding sets of numeric and bonus play attributes (12 numeric and 3 bonus play in the example). The player picks 1410 one object and the casino gaming machine 10 displays 1420 the associated attribute. In an optional embodiment using the bonus modifier step 1402 is entered, as shown by dotted lines in FIG. 14. When a bonus modifier is used, stage 1402 detects this and modifies bonus play accordingly in stage 1404 and then continues on to step 1420. The top numeric attribute is increased 1430 and the remaining attributes are re-randomized and re-assigned 1440 by the casino gaming machine 10 to the remaining displayed objects B in the touch screen 130. Steps 1430 and 1440 can be performed in different orders. When the picked object B reveals a numeric value attribute, then the player is allowed 1450 to pick another object B. This process continues until the object B picked by the player reveals a bonus play attribute (i.e., Pachinko 1, Pachinko 2, or Pachinko 3 of FIG. 13) in stage 1420 which results in bonus game play 1470. When the first bonus game play 1470 ends by the player, the casino gaming machine 10 changes 1480 all remaining numeric values in the attributes to "stoppers" and the player is permitted to select another object B in stage 1410. At this time, all remaining objects B that can be picked have either a stopper or a bonus play attribute associated with it. When the player picks an object B with an associated bonus play attribute another bonus game is played. When the player picks an object with an associated stopper attribute the casino game ends. The player continues to pick objects B until a stopper occurs in stage 1460. In another embodiment, in step 1480, the numeric values are not changed into stoppers; rather, associated with the numeric values are an additional stopper attribute. In this way, the player selecting an object that has a stopper attribute is also awarded the associated numeric value.

Pachinko Bonus Games: While any suitable bonus game can be played from the triggering events and the INTRO bonus game discussed above, the following three Pachinko bonuses are described below to illustrate the invention with a mechanical bonus game with a free motion ball.

Pachinko Bonus #1 "The Big One": Here only a single bail drops on the Pachinko playfield. Upon player selecting the object that initiates Pachinko #1, a separate screen is utilized to play the bonus on touch screen 130. At the same time, the top box display denotes "The Big One". The top box 30 animates the lanes and begins rapidly loading and replacing lane values (randomly according to the lane value algorithm) at a rate of approximately 10 lanes every 2 seconds. With each lane value loaded and/or replaced, a short sound effect plays. This is a Waiting Mode (the game is waiting for the player's input), but during this time the top-box 30 is dynamic and the combination of lane-values being loaded and sound effects heightens anticipation for the player. During Waiting Mode, on touch screen 130, a green button "PLAY" animates and the player may also be alerted, via on-screen text and character animation every 10 seconds to "Touch Button to Lock Lanes and Launch Ball!" or simply "Launch."

Once the player touches the button on touch screen 130, then immediately thereafter the next 10 lane values displayed (according to the algorithm) become "locked" as the lane values for the Pachinko game. In a preferred mode, the highest lane value is locked last so as to increase player anticipation and punctuate its value. Each "locked" sound effect is preferably different from that when the lanes are in Waiting Mode. Altogether, 10 locked sounds are heard by the player in the next 3 seconds after the player touches the button. Simultaneously with the player touching the button, on-screen "Look Up" graphics animate on touch screen 130. Once all 10 lane values are locked, a countdown series of beeps/sounds may be played for approximately 3-4 seconds if desired, and then the ball is released. Background music and/or overlaid notes are played as the ball drops.

Upon falling through a lane, the win is celebrated and the Bonus Win meter is incremented on-screen. A "Total Bonus Win" or "You Win" pop-up then appears. The lane population algorithm for the various number of initiating triggers is discussed next.

2, 3 or 4 Triggers: One "high" lane is randomly selected and its value is populated as drawn from the table in FIG. 15.

Thereafter, for the remaining 9 lanes, their values are drawn, with replacement, as shown in FIG. 16.

In all cases, the actual values depicted in the lanes shall be premultiplied by the line bet. This algorithm yields an average lane value of 0.1× the weighted average value of FIG. 15, plus 0.9× the weighted average value of FIG. 16. Hence, EV(Bonus 1, 2 Trigs)=308.59× line bet, EV(Bonus 1, 3 Trigs)=416.99× line bet and EV(Bonus 1, 4 Trigs)=916.48× line bet.

Triggers: With 5 triggers, we adopt the lane values of {2000×, 2250×, 2500×, 2750×, 3000×, 3500×, 4000×, 4500×, 5000×, 10000×} yielding an EV(Bonus 1, 5 Trigs)=3950× line bet.

Figure 17:
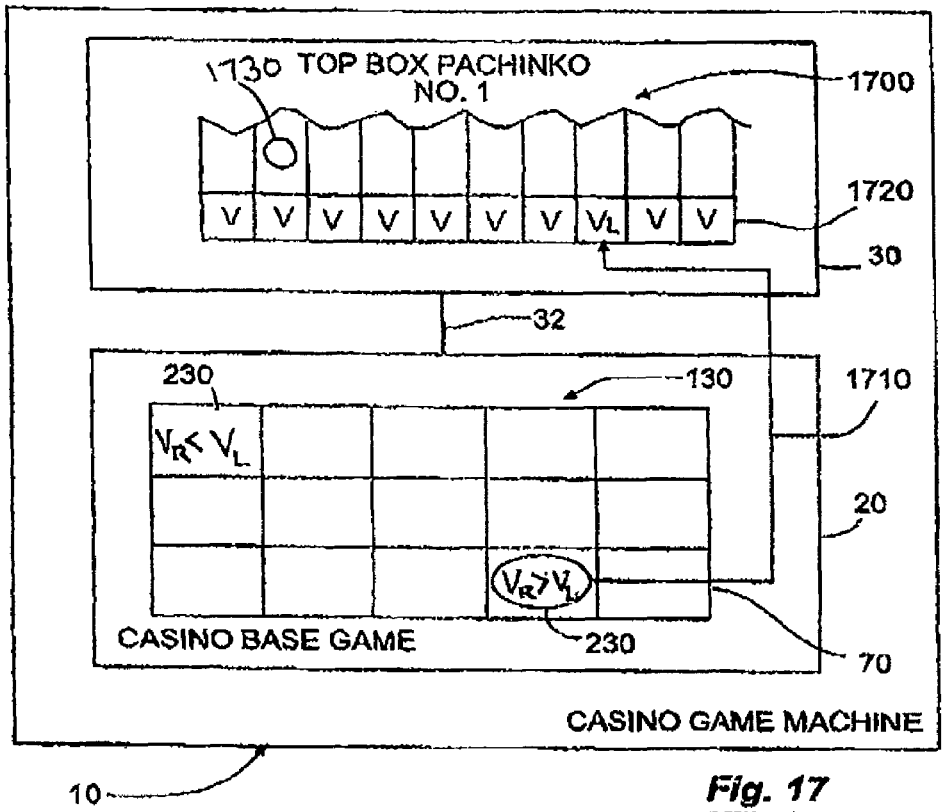
FIG. 17 is an illustration of events occurring in play of the casino base game increasing pay out awards in the bonus game.

In another embodiment in the top box Pachinko game 1700 as particularly shown in FIG. 17, the ten Pachinko lane values V 1720 are visible to the player during play of the base game, who gets to drop one or more balls 1730 upon entering this bonus game. The lane values 1720 are also updated based on various outcomes of the base game. For example, in one embodiment where 3 triggers are need to play the bonus game, the following happens upon aligning only one or two triggers (instead of the requisite three) in the casino base game 20. First, each trigger 230 automatically reveals a potential lane value in the base game outcome shown in screen 1300, for example drawn from a probability paytable such as those above (in a preferred embodiment the multiplier is premultiplied by the player's wager, so for example the lane value of 100 with a line bet of 3 would reveal "300"). If the revealed potential lane value is greater than the current minimum lane value (as currently visible on the Pachinko top box), then the revealed value VR takes the place of the minimum value VL as shown in FIG. 17 by line 1710 The line 1710 illustrates that the trigger 230 reveals a value VR greater than the lowest value VL in the lanes 1720 and the computer 100 replaces the displayed VL value with the higher value of VR. This concept may of course be extended to multiple values replaced, either simultaneously or sequentially as a result of a series of spins. So, for example, the player may have 2, 3 or even all 10 original values updated to higher awards in the ten lanes 1720, prior to actually entering the Pachinko bonus game. Even if a first player plays the casino game machine 10 and increases the Pachinko bonus game lane value, in the preferred embodiment the lanes stay populated for the next player as encouragement to play.

The advantage to this approach is that, as the lane values V increase in the Pachinko top box 30, the player is encouraged to keep playing the slot machine, so as ultimately to achieve the Pachinko bonus, and be rewarded with higher potential awards during one or more ball drops. In a preferred embodiment, after completing this Pachinko game, the lanes are immediately repopulated (for example, with the algorithm presented above utilizing FIGS. 15 and 16) based on the wager that initiated the just-finished Pachinko bonus.

Figure 18:
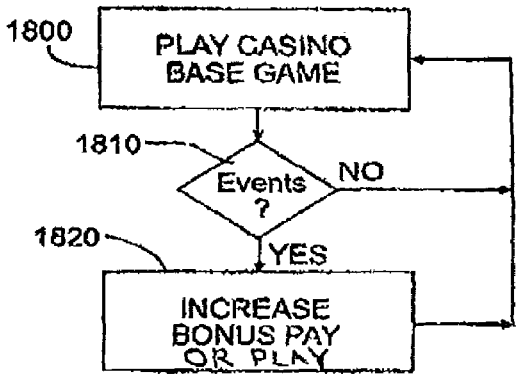
FIG. 18 is a flow chart of the invention increasing bonus pay awards as illustrated in FIG. 17.

This is summarized in FIG. 18 where during lay of the casino base game 1800 by a player, events may occur such as the two triggers discussed above. When they occur the casino base game in stage 1810 increases at least one displayed bonus pay off value in the bonus game in stage 1820 if the displayed value is greater as discussed. This occurs with audio/visual fanfare so that the player knows the at least one bonus award has increased. This encourages continued base game play and the possible continued increasing of the possible bonus awards. This feature is not limited to Pachinko bonus games, but may be used for any bonus game. While increasing bonus payouts is illustrated, bonus play can be increased or otherwise affected to benefit the player.

In an alternate embodiment, aligning fewer triggers than that required (for example, 2 instead of 3) or aligning triggers in the wrong orientation (for example, 3 scattered instead of 3 adjacent scattered) may cause the triggers to act as bonus modifiers, described earlier, in anticipation of ultimately triggering the bonus game. In this manner, the near miss of getting 2 triggers, instead of the requisite 3 triggers, can still be enjoyable, as the player is "building" and anticipating a better overall bonus payoff and experience, once qualifying for the bonus game.

In another embodiment, different algorithms may be utilized for originally populating the Pachinko lane values (for example, leaving the unwon lane values in play for the next visit to the bonus game) and updating the values during play of the base game. As well, the triggers need not be the symbols that update the lane values. Other symbols specifically dedicated to this effect may be utilized. Or, standard symbols may be utilized, such that either specific symbol combinations, or wins and/or losses of a specific amount may cause an update. Similarly, the update may be random and unrelated to the game outcome. It may also be the result of a series of wins, or losses, by the player. Too, the revealing of the value V need not take place on the base game screen. In the case of a mechanical stepper base game, the revealing of the value V may take place on a separate display or may take place on the top box display itself. Many different ways of triggering an update of the lane values are possible, during play of the base game in anticipation of playing the bonus game.

In another embodiment, one or more of the lane values may be an "ALL" which awards the sum total of the lane values. Alternately, one or more of the lane values may be a "×2" which doubles all numerical lane values, and drops another ball to determine the award. The use of the "×2" may be duplicated in subsequent ball drops, or may be curtailed wherein the "×2" lane may become a fixed value (e.g., 1000) or any other value as desired by design choice.

In yet another embodiment, the lane value chosen by the ball is further modified by having the player select (either before or after a ball drop) from among several objects, which in turn either modify the award (e.g., +100, ×2, ×3, −50, "Extra Ball Drop", etc.) or offer the player an option (e.g., "90/10 Double or Nothing?", "Re-do Ball Drop?", etc.).

In yet another embodiment, multiple ball drops are utilized until the ball lands in an "END" lane. So, for example, the initial lane values may have values such as {50, 100, 150, 200, 75, 50, ALL, 125, 35, 45}. During game play, the player keeps any lane awards landed in. If a ball drops into the ALL lane, the player is awarded the sum of all the remaining lane values (in this case, initially 830), ending the bonus game. Each time a lane is landed in, for the next drop, the lane's value is replaced with an END lane. By way of example, if the first drop lands in the 100 lane, the player is awarded 100 credits. Preferably, the lanes are re-randomized and displayed, e.g. {200, 50, 125, 45, 35, ALL, END, 150, 50, 75}. The ALL would now be worth 730, the new sum of the remaining lanes, since the value of 100 has already been awarded. This process (of awarding the lane landed in and replacing it for the next drop with an END) continues until either all the numeric lane values are won, the ALL is landed upon, or END is landed upon. In this way, even if the player gets the ALL on, say, the 4th ball drop, the total won will still be the original ALL total, namely 830 credits. In another embodiment, the numeric lane values are redrawn from a probability paytable or a pool of possible lane values, prior to each ball drop, and the number of END lanes are incremented in the same manner described above but do not necessarily replace values already landed upon. Of course, the number of END lanes may increment by more than one for each drop. In another embodiment, the lanes may begin with one or more END lanes, or after each ball drop, one or more numeric lanes may be incremented, etc.

Pachinko Bonus #2 "Double-or-Nothing Heaven": On-screen, 7 clouds are presented. The Oogie character, with angel wings, flies onto the screen 130 and hovers. He "awards" the player between 1 and 3 "Free Peeks". The player is then prompted to pick the number of clouds to "peek" at. Each touched "peek" cloud partially dissolves revealing the hidden award behind it. In a preferred embodiment, immediately after each peek the remaining clouds are randomized and re-assigned prior to the next player pick as discussed earlier. However, in another embodiment, the cloud values are fixedly associated with the clouds and do not change after each pick. In yet another embodiment, the cloud values are randomized, or rotated, after a specific pick number (e.g., the first pick, or prior to the last pick). In allowing the player to peek, the player is given additional excitement in knowing where certain values or attributes are located, prior to actually picking them. It also allows for an element of strategy to be introduced into the game. In one embodiment, peeks may be accumulated in a prior bonus, e.g., through the use of bonus modifier attributes.

Once the peeking is finished, the player is then prompted to choose any one of the 7 clouds to reveal the starting amount for the "Double-or-Nothing" (DoN) feature. This starting amount becomes the original amount at-risk (the Current Award) in the double-or-nothing game. The starting value is moved up to top-center of screen 130 under a banner that says "Current Award" (e.g., 50 credits). Thereafter, the remaining cloud values are shown superimposed in grey, briefly, and then all clouds vaporize. The cloud values for this example are shown in FIG. 19 and the peek probabilities are shown in FIG. 20.

After the "peek" feature with the values shown in FIG. 19, it is correct for the player to always try for the "All" cloud. I.e., if none the value(s) revealed during peeking is the "All" symbol, the player should choose from among the other clouds; obviously if a peeked value is "All" then this same "All" cloud should be picked. With this strategy, the average starting amount for 3 Triggers is equal to 81.54× line bet. For 4 Triggers, it is 222.12× line bet; for 5 Triggers, it is 716.52× line bet.

While the example above includes an "All" symbol, other embodiments are possible and the "peek" feature is not limited to numeric values either with or without one or more "All" symbols. In principle, the peek feature can be utilized in any game wherein the player must ultimately pick one or more objects, and wherein the player may first peek at the hidden attributes, or hidden values, associated with the objects before picking. It may also be used in an alternating method by having one peek, then a pick, then another peek, then another pick, etc. from among a set of objects. Many variations are possible on this peeking teaching.

Too, the number of peeks may be a function of the player's wager, or the number of initiating triggers. Peeks may be accumulated during the base game, for example by aligning too few triggers, or aligning triggers in an unqualifying orientation, to be "spent" during a bonus game, etc.

One such variation applicable to gaming devices utilizes trivia in a bonus game. During the base game, three triggers may be required to initiate a bonus trivia game. However, two triggers (a near miss) may award the player a "peek" banked for future use in the bonus game. The peeks may accumulate in the bank to a maximum number of peeks (which may be only 1 or it may be several). Once qualifying for the bonus, the player may be presented with a trivia question and four possible answers, only one of which is correct. The player is rewarded based on the number of guesses required to answer correctly. For example, the awards may be 100× for getting the answer right on the 1st guess, 75× for getting the right answer on the 2nd guess, 50× if right on the 3rd guess and 25× if right on the 4th and final guess. Rather than have the player immediately guess at the answer, the player may be allowed to peek at the response to, say, 2 possible answers (if the player had 2 peeks in the bank). Each response might indicate "Right!" or "Wrong" or thumb up/down. So, by peeking at 2 of the answers, the player either will either know the right answer (with probability 50%), or will have eliminated two of the wrong answers. The probability for a "no knowledge" player to obtain the correct answer on the 1st guess (without peeking) is 0.25. However, with 2 peeks prior to having to select the final answer, this probability rises to 0.5+0.5(0.5)= 0.75, a marked improvement!

The number of clouds with an All symbol may also be tied to the number of peeks. For example, if there is only 1 All symbol, the player may be awarded an average of 3.2 peeks. If there are 2 All symbols, the player may be awarded an average of 2.1 peeks, etc.

It is to be understood that any suitable bonus game using a different theme than clouds can be played. While seven objects (clouds) are used in the example above any number of objects can be used as taught herein. Likewise, the number of free reveals (peeks) can be any suitable number. In one embodiment, a player peeking at the best possible outcome (e.g., All) is automatically awarded this outcome, without having to choose it.

For a Pachinko bonus embodiment, in one embodiment, assume the player has wagered 2 per line and is given 1 peek. The player peeks at the "40" (40 credits equal to 20× multiplier and 2 credits per line) cloud. Now having to make a pick, the player chooses a different cloud which reveals "50" (50 credits equal to 25× multiplier and 2 credits per line). This becomes the Current Award for the DoN Pachinko bonus feature.

It is to be understood that the above play can be optional and that the Pachinko Bonus #2 game could be entered using an award directly from the casino base game. In another preferred embodiment, the player is given an initial Current Award, and adds to it by picking one or more clouds without peeking in advance.

Figure 21:
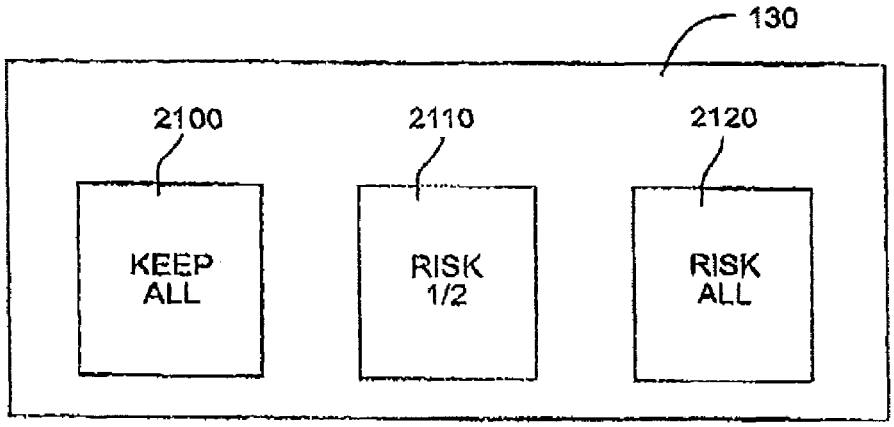
FIG. 21 illustrates the screen display for the double or nothing bonus Pachinko game of the invention.

Thereafter, three boxes pop onto the screen 130. The left box 2100 as shown in FIG. 21 blinks pink/red and states, e.g., "Keep All." The right box 2120 blinks light green/green and states, e.g. "Risk All" and underneath "Double or Nothing" and "90% chance of success!" The middle box 2110 is yellow and suggests "Risk ½". The various boxes (red, yellow, green) animate and/or blink so as to imply a call for player action.

Figure 22:
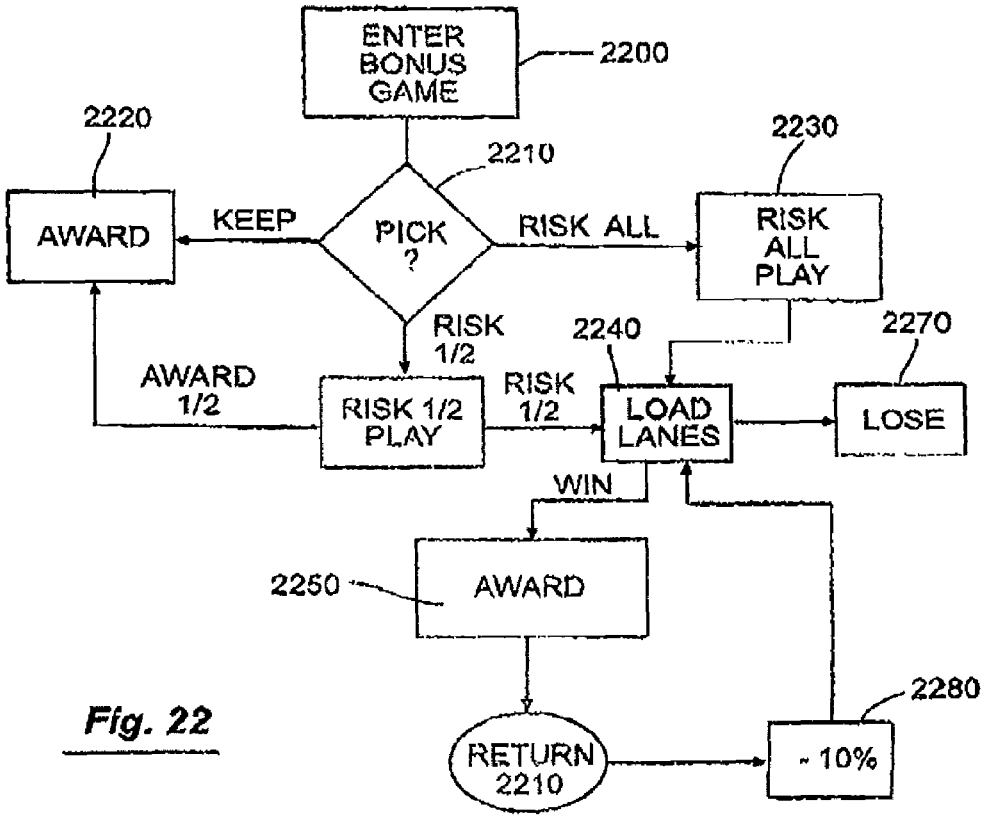
FIG. 22 is a flow chart of the invention setting forth play of the double or nothing Pachinko bonus game.

The play 2200 of this bonus game is set forth in FIG. 22, if the player chooses to Keep All in stage 2210 by touching 2100, then the Current Award is incrementally added 2220 to the Bonus Win meter. The win is celebrated and the Bonus Win meter is incremented on-screen. The "Total Bonus Win" or "You Win" pop-up then appears.

If the player chooses in stage 2210 to go for the Risk All by touching the "Risk All" symbol 2120 on touch screen 130, the Current Award drops to zero in stage 2230, and the top-box loads in stage 2240 the appropriate number of lane values (e.g., 9 lanes of 100 and 1 lane of 0) simultaneously and instantly (as opposed to sequentially), in a preferred mode. The player has, e.g., a 90% chance of doubling up in stage 2240. An audible countdown with pulses takes place, culminating in an automatic ball drop also in stage 2240 with ensuing result. If result is a win, the award is doubled in stage 2250 and the player is again afforded the option in stage 2260 to Keep All, Risk ½ or Risk All by returning to stage 2210 (perhaps at a different chance of success, e.g. 80/20). If result is a loss (zero in the lane), then stage 2270 is entered and music may immediately "scratch" and shut off. Preferably, a trumpets "wah-wah-wah-waaah" may be played to playfully highlight the loss. The "Total Bonus Win" pop-up then appears, equal to zero.

After a successful drop, when the player touches risk all 2120 again in stage 2260, then in stage 2240, e.g., 80% is loaded into the Pachinko lanes (8 lanes with 100% win and 2 lanes with 0% win) which are randomized and assigned. In a preferred embodiment, the player may continue to risk all 2120 or risk ½ 2110 until a predetermined number of successful drops have occurred, or until an unsuccessful drop occurs. In one embodiment, after each successful drop, stage 2280 decrements the percentage chance of winning with each successful "Risk ½" or "Risk All" selection 2120 by ten percent until the game is over.

If the player chooses to go for the Risk ½ then upon touching the Risk ½ 2110 symbol on-screen, the Current Award drops to half, and the top-box loads the appropriate number of lane values (e.g., 9 lanes of 50 and 1 lane of 0) using the instant load algorithm. A countdown with pulses may be utilized prior to the automatic ball drop with ensuing result. If result is a double, then again the player is afforded the option to Keep or DoN, for example this time at 80/20, then 70/30, 60/40, and lastly at 50/50. If result is nothing, then again a trumpet may play "wah-wah-wah-waaah". The "Total Bonus Win" pop-up then appears, equal to remaining Current Award plus INTRO Bonus.

In summary:

1) The player is offered the choice of "Keep All" blinking with a pink/red glow, "Risk ½" blinking with a yellow glow, or "Risk All 90/10 Double or Nothing" blinking with a light green/green glow.

2) Here (and at all subsequent choices between Keep and DoN) the player must make one of three choices:

2a) If the player chooses to Keep the award, the bonus ends with the Current Award added to the Bonus Win.

2b) If the player chooses to Risk All and go for the DoN, then upon touching the DoN symbol on-screen, the Current Award drops to zero, and the top-box loads the appropriate number of double values (e.g., 9 lanes of 100) and nothing values (e.g., 1 lane of 0). The lane values are randomly distributed. A ball drop occurs with ensuing result.

2b1) If result is double, then again the player is again afforded (step 1) the option to Keep, Risk Half or Risk All, but preferably at a reduced advantage, i.e. 80/20, then 70/30, 60/40, and ultimately at 50/50.

2b2) If result is nothing, then music ends and play "loser" sound effect. Bonus Win (if any) remains equal to that earned prior to the DoN bonus, e.g. from INTRO Bonus.

2c) If the player chooses to Risk Half, then upon touching the Risk Half symbol on-screen, the Current Award drops to half (e.g., 50 credits. In the case of odd credits, it is preferred to keep the extra 0.5 credit on Current Award. E.g., if Current Award is 125 credits and player chooses Risk Half, then 63 credits would remain in Current Award and 62×2=124 would be in the doubling Pachinko lanes). The top-box loads the appropriate number of double values (e.g., 9 lanes of 50) and nothing values (e.g., 1 lane of 0). The lane values are randomly distributed. A ball drop occurs with ensuing result.

2c1) If result is double, then again the player is again afforded (step 1) the option to Keep, Risk Half or Risk All, but at a reduced advantage, i.e. 80/20, then 70/30, 60/40, and ultimately at 50/50.

2c2) If result is nothing, then music ends and play "loser" sound effect. Bonus Win is equal to that from remaining Current Award plus that earned prior to the DoN bonus, e.g. from INTRO Bonus.

In one embodiment, the player is offered doubling at 90/10, 80/20, 70/30, 60/40 and 50/50. Optimally, the player should accept the Risk All DoN at the 90/10, 80/20, 70/30, and 60/40 levels (at the 50/50 level, each option has the same expected value). So, from an EV perspective, the player has 4 doubling decisions to make. If the player correctly tries to double each time, the chance of success is 0.9×0.8×0.7×0.6=0.302, for a total win of 16× the starting amount. Hence, the EV from the DoN feature is 0.302×16=4.838× starting amount.

To preserve a Pachinko apparatus free from bias, in the preferred embodiment the lane values are randomized prior to each ball drop as taught in the prior art.

In another embodiment, the player may be given further or fewer doubling opportunities, for example 40/60 (which is not to the player's advantage to take). In one embodiment, the player is afforded only one doubling opportunity, and the determination of whether it is 90/10, 80/20, 70/30 or 60/40 is based on a probability table. In one embodiment, the player is afforded sequential high probability (e.g., 90/10 and 80/20) doubling opportunities, in order to yield a high (72%) probability of succeeding in both opportunities. In yet another embodiment, the odds may be adjusted in accord with the lanes. For example, the player's expected value when offered an 80/20 "double or nothing" is 0.8(2)+0.2(0)=1.6× Current Award. Instead, the lanes may be populated such that half of them are 3.2× Current Award, and the other half are zero. This 50/50 "3.2× or nothing" also has an expected value of 0.5 (3.2)+0.5(0)=1.6× Current Award. Or, if integer multipliers are preferred, one lane might be 4×, four lanes at 3×, and the rest at zero, still leading to an expected value of 0.1(4)+0.4 (3)+0.5(0)=1.6× Current Award. Clearly, other embodiments are also possible.

In another embodiment, the player may play the DoN Heaven game with a "save". The save would function in a manner in which the player, upon having a ball land in a zero lane, would be able to use the save to not have the Current Award drop to zero. In other words, anytime the player accepted a double-or-nothing opportunity and had a save in hand, the risk would be zero. For example, a player has a Current Award of 100 and chooses to Risk All on a 70/30 double or nothing. The lane values are populated, randomly, such that 7 lanes have the value 200 and 3 lanes have the value 0. The ball lands in a lane with value 0. If the player had no saves remaining (or if the embodiment didn't include the use of saves), the feature would end and the player would have lost the entire Current Award. However, a player using the save would save his Current Award. In a preferred embodiment, the player would be given the option, again, of retrying the 70/30 double or nothing with a Current Award of 100 (again with 7 lanes at 200 and 3 lanes at 0). Alternatively, the save would cause the feature to end, but would still award the player the Current Award prior to the losing double- or nothing ball drop. In still another embodiment, the save would not cause the feature to end, but would automatically (i.e., not at the player's option) replay the 70/30 double or nothing, and only if successful would the player then be allowed to Keep All. Other variations are possible. What is important is the concept of the player having one or more saves, which may be used to save the amount at risk during the double-or-nothing feature.

In one embodiment, the player may accumulate saves in the INTRO ball screen described earlier. Alternatively, the player may accumulate saves in the base game, for example, by aligning a special save symbol or symbols. Alternately, the player may accumulate a save by coming close to going to a bonus game (e.g., 2 triggers appear when 3 are needed). Alternately, in a dual-stage qualification wherein triggers must first align, and then the player must choose the correct trigger to start the bonus game, a save may be awarded if the player chooses an incorrect trigger. This incentivizes the player to keep playing, and makes the wrong choice more acceptable in that at least the player accumulated a save.

In one preferred embodiment, the player has opportunities to double only at the 90/10 and 80/20 levels for 3 or more triggers initiating a bonus game (through the INTRO Bonus game), and only one opportunity chosen randomly from the 90/10, 80/20, 70/30 and 60/40 levels for 2 adjacent triggers. The player has (at most) 2 doubling decisions to make. With 3 triggers, if the player correctly tries to double each time, the chance of success is 0.9×0.8=0.72, for a total win of 4× the starting amount, leading to an EV of 0.72×4=2.88× the average starting Current Award. In another embodiment, 3 doubling opportunities are given at 90/10, 80/20 and then 70/30. Hence, the EV from the DoN feature is 0.504×8=4.032× the average starting Current Award.

In a preferred embodiment, for the case in which 2 triggers launch the bonus game, if the player wins nothing during the DoN Bonus (because the ball ends in a "Nothing" or zero lane), the unselected base game Oogie character throws a temper tantrum (Temper Tantrum Feature) and awards one of 50×, 55×, 60×, 65×, 70× line bet. This is so that the player who initiates the feature will always win something. For 2 triggers and a single drop with an average 80% chance of success, the EV is therefore 0.8×2=1.6× the average starting Current Award plus the Temper Tantrum Feature, which occurs with probability 0.2 awards an average of 60×.

Figure 23:
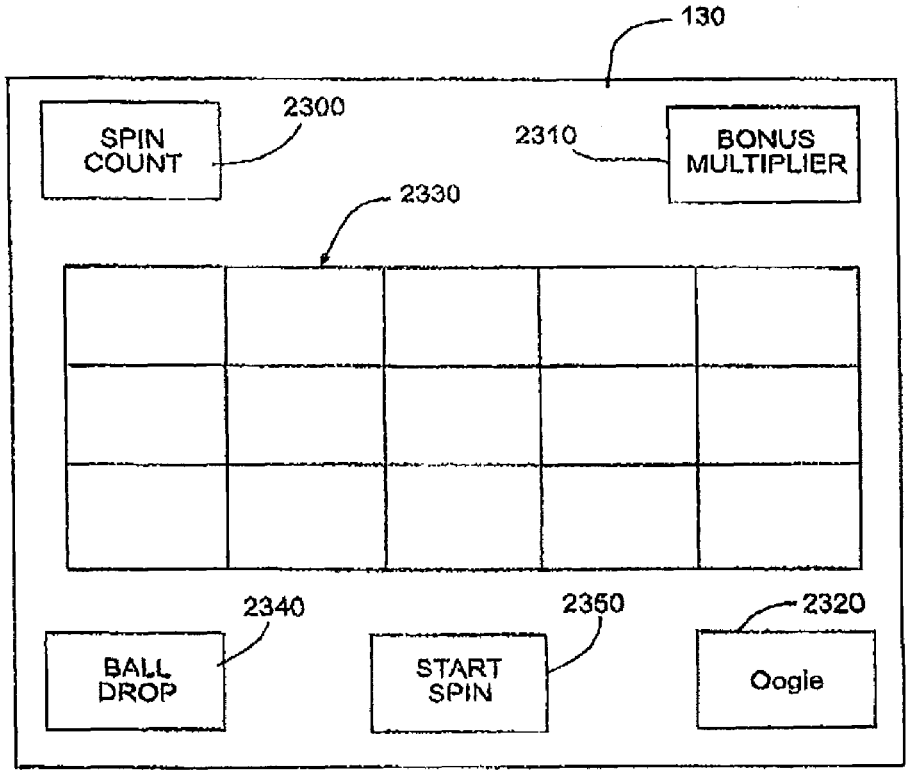
FIG. 23 is a base game screen display for Pachinko Bonus Game #3 of the invention.

Pachinko Bonus #3 "Drop, Spin & Win": This feature utilizes a "back and forth" between the top box 30 and the free spin feature in the display 130. Upon the player selecting the object that initiates Pachinko #3 from the INTRO Bonus Game (or the correct trigger symbol with 2 adjacent trigger symbols directly from the base game), a separate second-screen in display 130 as shown in FIG. 23 with bonus reels is utilized to play the bonus game. Music initiates, and the top box display animates to show "Drop, Spin & Win". Top-left on screen 130 is the counter 2300 for number of free spins remaining. Top-right is the bonus multiplier 2310 for all wins except the top award. The Oogie character 2320 is preferably located bottom-right below the 5th reel of the 5×3 reel matrix 2330. All wins during the free games are credited to the Bonus Win meter. Superimposed over the reels as a pop-up, the player is prompted to touch an on-screen button 2340 (depicted in FIG. 23 below the reels for clarity) for the first ball drop in the Pachinko top box bonus game.

When the player touches the on-screen button 2340, it disappears and on the pop-up the "Look Up!" animations play, in which the player is prompted to look up at the top box 30. Thereafter (or at the same time as the pop-up for the player to touch) the lane values are loaded in the top box 30.

Lane Loading Version 1: The top box is randomly loaded with the following numerical values in the ten Pachinko lanes, each representing a number of free spins.

2 Triggers: 1, 1, 2, 2, 2, 2, 3, 3, 3, 3

3 Triggers: 1, 1, 2, 2, 2, 3, 3, 4, 4, 5

4 Triggers: 2, 2, 3, 3, 4, 4, 5, 6, 7, 8

5 Triggers: 5, 5, 6, 7, 8, 9, 10, 10, 12, 15

After each set of spins, the lanes chosen are each replaced with an "END" designation, and those not chosen are rerandomized and redisplayed. In this version, the values of a subsequent set of lanes are a function of lane values already landed upon.

Lane Loading Version 2. The top box is loaded with the randomized, original set of values of Lane Loading Version 1. After each set of spins, the remaining lanes (that are not End lanes) are redrawn, with replacement, from the same original set. In this manner, the player may obtain, for example in the case of 3 triggers, a set of 5 Free Spins more than once. In this version, each numeric value will not necessarily appear in a particular set of lane values. The values of a subsequent set of lanes are independent of any lane values already landed upon.

Figure 24:
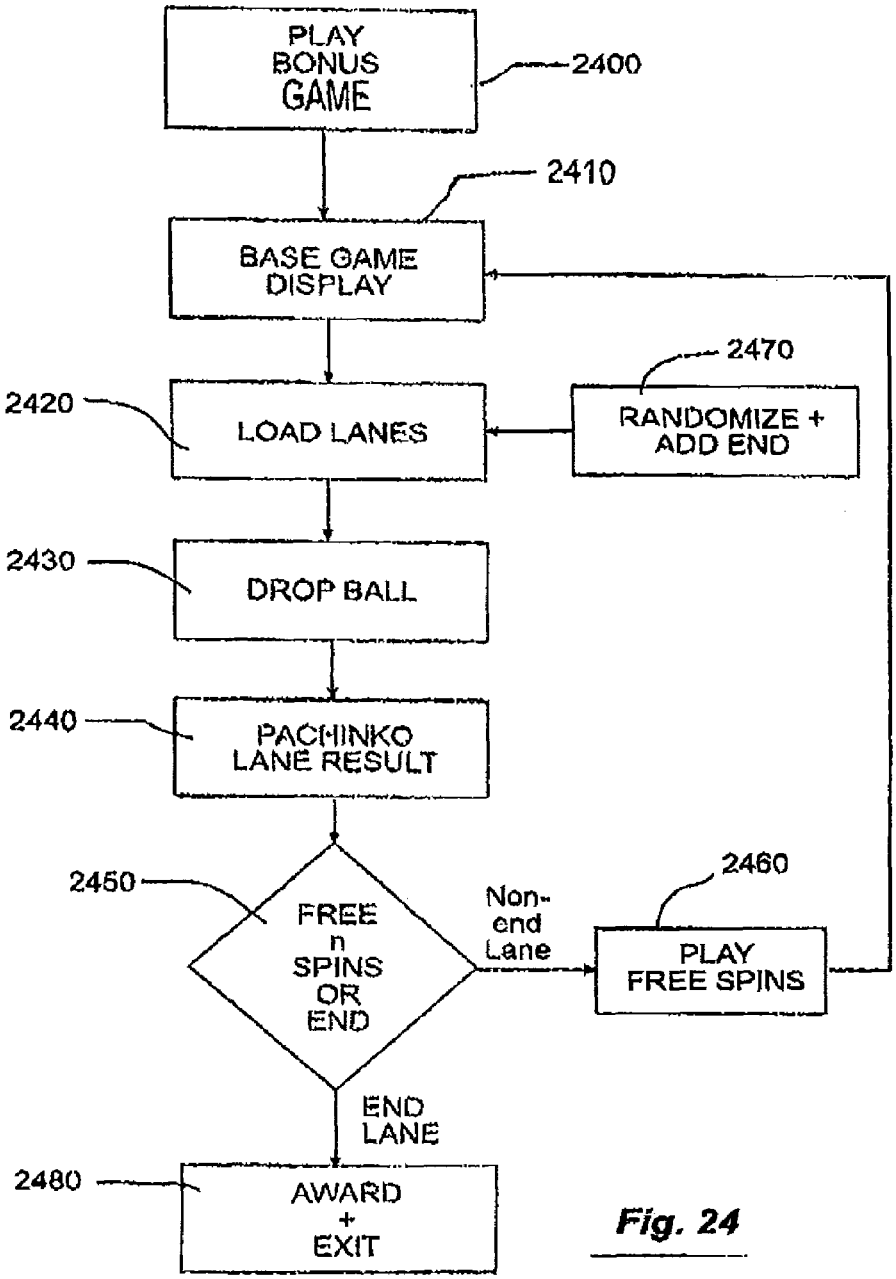
FIG. 24 is a flow chart of the invention for play of Pachinko Bonus Game #3.

As shown in FIG. 24, the play bonus game stage 2400 is entered for Pachinko Bonus Game #3, as discussed above, and the screen display of FIG. 23 is presented to the player in stage 2410 as well as the animations and pop ups. The ten lanes of the top box Pachinko 30 are loaded with values based on the algorithms discussed above in step 2420. The countdown starts and the ball is dropped (e.g., into a lane of value 3) in stage 2430. The lane selected by the ball determines the first set of free spins (e.g., 3 spins) in stage 2440. In a preferred embodiment the multiplier begins at 1×. The base game on-screen multiplier 2310 begins at 1×. Within the pop-up box, the "Look up!" disappears and the player is informed, "You Win 3 Free Games at 1×". The top box display may also mirror the information. Superimposed on the base screen, a button 2350 for the player to "Start" may appear (depicted in FIG. 23 below the reels for clarity), but in a preferred embodiment the Free spins begin automatically. The free spin games play in reels 2330 during stage 2450. The first set of free games is played at this multiplier.

With each reel spin in stage 2450, the number of free spins remaining on the base screen in spin count 2300 decrements by one. With the first win in each set of games, Oogie pulls out a yellow flag embossed with "1×" and holds it. Once this set of free spins is finished, the process repeats itself in stage 2460. The pop-up on the base screen reappears, etc. In Version 1, the top-box Pachinko lane values are preferably re-randomized in stage 2470, with the value(s) previously chosen by the dropped ball(s) instead now stating "End" (or alternatively an X or frown face or other symbol that depicts an end outcome). In Version 2, they are redrawn from the original set, without regard to any values previously landed upon. In either case, this re-randomization in stage 2470 ensures that any bias in the Pachinko apparatus will not affect the mathematical house advantage, or hold, associated with the slot machine. The re-randomized values and end symbols are re-loaded in the lanes in stage 2420.

Another ball is dropped in stage 2430. The lane selected 2440 by the next dropped ball determines what happens next. If the ball drops through a lane depicting an End symbol, then in stage 2450 the bonus is over by entering stage 2480. Preferably, this is accompanied by a record-scratch sound, ending the music and highlighting that the bonus is ending.

If the ball drops 2430 through a numerical value, then the player receives another set of free spins in 2450. Additionally, if Oogie 2320 is holding a "1×" flag, then the flag is tossed onto the bonus multiplier above to increment it (e.g., to 2×) immediately prior to initiating the next set of free spins. The Oogie character keeps his position below the reels (with hands empty until the first win of this next set, which again would cause Oogie to pull out a flag that says "1×", etc.). Once a lane depicting End is chosen, the bonus is over. On average, as determined by simulation of 10,000,000 games, the average number of drops until the "End" is 4.66 drops. On-screen a Total Bonus Win box pops up. For particularly big wins, an on-screen or audio celebration may take place.

In a preferred embodiment, a separate set of Bonus Reels are utilized, which do not have the base game Trigger Symbols but have other scatter pay symbols. All wins are credited to the Bonus Win meter. In a preferred embodiment, if the player gets any win (that is, any credits greater than zero are awarded) during a set of free spins, then the first time doing so during the set an Oogie character below the reels will pull out a flag that says "1×".

In a preferred embodiment, the hit frequency (for 30 lines) of the Bonus Reels utilized during the Free Spin bonus is approximately 52%-56% with an ER per spin (with multiplier of 1×) of 0.82-0.90. In a preferred embodiment, the top award is not multiplied by the bonus multiplier.

In a preferred embodiment, for 2 triggers only, if the player wins nothing during the Drop, Spin and Win Bonus, the unselected base game Oogie character throws a temper tantrum (Temper Tantrum Feature) and awards one of 60×, 80×, 100× line bet.

Other embodiments are possible. For example, the bonus multiplier might increase after every set of free spins prior to the next set, or it might increase after a first non-winning spin in a set (instead of the preferred embodiment which is after the first win in a set of free spins). Or, it may increase when specific combinations of symbols appear, or after each occurrence of a specific number of symbols. Alternately, a special symbol or combination of symbols may be required to increment or increase the multiplier. These symbols may act immediately to increment the multiplier or instead may be accumulated during one set of free spins, so as to act upon the multiplier for the next set of free spins (provided the player succeeds in obtaining a next set of free spins) as in the preferred embodiment.

Too, the multiplier may increase by an amount that is different from 1×, for example 2× after every set of free spins. Or the multiplier's increase may not be constant but may grow after each set of free spins. For example, the first set may be at 1×; the second set may be at 3×; the third set may be at 6×, etc. Combinations of these embodiments are also possible wherein, for example, the multiplier's increase need not be constant but the player must have at least one win during a set of free spins to obtain an enhanced multiplier for the next set of free spins.

In yet another embodiment, a final bonus multiplier applied to one or more final spins may be utilized which acts only when the player has run out of free spins (that is, the player finishes a set of free spins and the subsequent Pachinko ball-drop lands in a lane showing End). In this case, a ball landing in End does not finish the bonus immediately, but awards a conclusion of one or more final free spins at the final bonus multiplier. The use of such a final bonus multiplier may be instead of the bonus multiplier described earlier (and associated with each set of free spins) or in addition to the bonus multiplier described earlier.

In one embodiment the final bonus multiplier is a function of the current bonus multiplier. For example, consider a case with initial lane values of 3, 2, 2, 3, 2, 3, 4, 10, 5, 3. Ball number 1 drops into a lane of value 3. The player gets 3 free spins at 1×. The spins result in outcomes of 0 credits, 20 credits, 10 credits. Because the player obtained at least one win (of any number of credits greater than 0), the bonus multiplier would increase (in a preferred embodiment to 2×) on the next set of free spins, but only if the player first successfully plays Pachinko and lands the ball in a lane that does not end the game. The next set of lane values, re-drawn and randomized and including the End are as follows: 3, End, 3, 10, 5, 2, 2, 10, 4, 3. Ball number 2 drops into a lane value of 5. The player gets 5 free spins at 2×. The spins result in outcomes of 50 credits (a win of 25×2), 10 credits (a win of 5×2), 100 credits (a win of 50×2), 0 credits, 0 credits. Again because the player obtained at least one win, the bonus multiplier would increase (in a preferred embodiment to 3×) on the next set of free spins, but only if the player first successfully plays Pachinko and lands the ball in a lane that does not end the game. The next set of lane values, re-drawn and randomized and including now two End symbols are as follows: End, 3, 2, 3, 2, 4, 5, 3, End, 2. Ball number 3 drops into an End lane. In a preferred embodiment, the bonus game is now over and the player is awarded 20+10+50+10+100=190 credits. In an alternate embodiment, a final bonus multiplier of 4× (equal to double the player's last bonus multiplier of 2×) is awarded the player for one final spin. This award, if any, is then added to the previous awards won during the bonus.

The above disclosure sets forth a basic embodiment of the invention described in detail with respect to the accompanying drawings with a number of variations discussed. Certain precise attributes, values, probabilities, and algorithms have been utilized in the specification. However, these do not limit the scope of the claimed invention and that variations in can occur under variations of the invention. The themes present herein are by way of example only to illustrate the invention.

It is noted that the terms "preferred," "preferable" and "preferably" are given their common definitions and are not utilized herein to limit the scope of the claimed disclosure. Rather, these terms are intended to highlight alternative or additional features that may or may not be utilized in a particular embodiment of the present disclosure.

Those skilled in this art will appreciate that various changes, modifications, use of other materials, other structural arrangements, and other embodiments could be practiced under the teachings of the invention without departing from the scope of this invention as set forth in the following claims.

I claim:

1. A casino game played in a casino gaming machine comprising:

displaying in a touch screen of the casino gaming machine a set of objects, each object having a randomly assigned attribute from a corresponding set of attributes;

assigning a player one or more opportunities to select an object from said set of objects relative to a round of play;

receiving in the casino gaming machine a player input when said player touches a selected one of said objects in said set of objects;

displaying in the touch screen a symbol or numeric value corresponding to said randomly associated attribute for said selected object in said set objects; and if said player is entitled to any additional selections:

removing from further selection said selected object from said set of objects to leave remaining objects from said set of objects;

re-assigning the remaining attributes to the remaining objects before the player touches the next object; and receiving in the casino gaming machine another player input when said player touches another selected one of said remaining objects.

2. The casino game of claim 1 wherein re-assigning comprises: re-randomizing the remaining attributes in the set of attributes to the remaining objects in the set of objects.

3. The casino game of claim 1 wherein re-assigning comprises: rotating by the casino base machine the remaining attributes in the remaining objects at least to the adjacent object.

4. The casino game of claim 1 wherein at least one attribute is a bonus modifier.

5. The casino game of claim 1 further comprising:

increasing by the casino base machine at least the top numerical value in the remaining associated attributes of said set of attributes that have not been displayed.

6. The casino game of claim 1 wherein the set of attributes at least includes a plurality of numeric values and at least one casino bonus game play.

7. The casino game of claim 1 wherein the set of attributes at least includes a plurality of numeric multiplier values and wherein the symbol displayed shows a win award value that is based on a wager and the assigned numeric multiplier value.

8. A casino game played in a casino gaming machine comprising:

displaying in a touch screen of the casino gaming machine a set of objects, each object having a randomly assigned attribute from a corresponding set of attributes, the set of attributes at least having numeric values and at least one bonus game play symbol;

receiving in the casino gaming machine a player input when said player touches one selected object in said set;

displaying in the touch screen a symbol corresponding to said randomly associated attribute for the touched object in the number of objects in said set;

removing from potential selection the selected object, leaving a number of remaining objects for selection;

re-assigning the remaining attributes to the remaining objects that have not been touched before the player touches the next object;

playing a bonus game when the displayed symbol is a bonus game symbol, said bonus game comprising a game other than the selection of said objects;

repeating the steps of receiving, displaying, removing and re-assigning when the displayed symbol displayed is a numeric award value or after playing the bonus game; and ending the casino game when a predetermined number of player inputs has occurred or there are no remaining objects.

9. The casino game in accordance with claim 8 wherein said bonus game comprises a Pachinko game.

10. The casino game in accordance with claim 9 wherein said Pachinko game comprises dropping at least one physical ball through a game board into one or more lanes.

11. The casino game in accordance with claim 9 wherein said Pachinko game is presented in a top box of said casino gaming machine.

12. A casino game played in a casino gaming machine comprising:

displaying in a touch screen of the casino gaming machine a set of objects, each object having a randomly assigned attribute from a corresponding set of attributes, the set of attributes at least having numeric values and at least one bonus game play symbol;

receiving in the casino gaming machine a player input when said player touches one selected object in said set;

displaying in the touch screen a symbol or numeric value corresponding to said randomly associated attribute for the touched object in the number of objects in said set;

removing from potential selection the selected object, leaving a number of remaining objects for selection;

repeating the steps of receiving, displaying and removing when the displayed symbol displayed is a numeric award value;

playing a bonus game when the displayed symbol is a bonus game symbol and associating all remaining numeric value attributes with a stopper attribute;

repeating the steps of receiving, displaying and removing, until the displayed symbol is associated with a stopper;

ending the casino game when a displayed symbol is associated with a stopper.

13. The casino game in accordance with claim 12 wherein said bonus game comprises a Pachinko game.

14. The casino game in accordance with claim 13 wherein said Pachinko game comprises dropping at least one physical ball through a game board into one or more lanes.

15. The casino game in accordance with claim 13 wherein said Pachinko game is presented in a top box of said casino gaming machine.

* * * * *